US010265972B2

(12) United States Patent
Hojo

(10) Patent No.: US 10,265,972 B2
(45) Date of Patent: Apr. 23, 2019

(54) INK JET PRINTING APPARATUS AND DRYING INTENSITY SETTING METHOD THEREOF

(71) Applicant: FUJIFILM Corporation, Tokyo (JP)

(72) Inventor: Hiroaki Hojo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/716,523

(22) Filed: Sep. 27, 2017

(65) Prior Publication Data

US 2018/0086108 A1 Mar. 29, 2018

(30) Foreign Application Priority Data

Sep. 29, 2016 (JP) ..... 2016-191283

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002; B41J 11/0015
See application file for complete search history.

(56) References Cited

U.S. PATENT DOCUMENTS 9,221,279 B2 12/2015 Houjou
2013/0257964 A1* 10/2013 Itogawa ..... B41J 13/0009 347/16
2015/0246556 A1 9/2015 Houjou

FOREIGN PATENT DOCUMENTS

EP 1777069 4/2007
JP 2015164786 9/2015
JP 2016107419 6/2016

OTHER PUBLICATIONS

"Search Report of Europe Counterpart Application", dated Feb. 7, 2018, p. 1-p. 6, in which the listed references were cited.

* cited by examiner

*Primary Examiner* — Geoffrey S Mruk
(74) *Attorney, Agent, or Firm* — JCIPRNET

(57) ABSTRACT

There are provided an ink jet printing apparatus that can appropriately set drying intensity and a drying intensity setting method thereof. An ink jet printing apparatus includes a printing section that prints an image on a sheet with aqueous ink by an ink jet method, an ink drying section that dries the ink by heating the sheet having been subjected to printing, and a varnish coating section that coats the sheet of which the ink has been dried with UV varnish. The drying intensity of the ink drying section is set so that temperature where the sheet reaches is in a prescribed range. Regions corresponding to the same drawing conditions are extracted from an image to be printed, and drying intensity is set on the basis of a drawing condition corresponding to the maximum occupied area among the regions.

13 Claims, 25 Drawing Sheets

| REGION | DRAWING CONDITION | | OCCUPIED AREA | AREA OCCUPANCY |
|---|---|---|---|---|
| | COLOR | AMOUNT OF INK | | |
| A1 | K | 3.5 [pL] | S1 | 10% |
| A2 | C | 0.8 [pL] | S2 | 8% |
| A3 | M | 2.0 [pL] | S3 | 40% |
| A4 | R | 2.4 [pL] | S4 | 2% |
| A5 | B | 4.4 [pL] | S5 | 30% |
| A6 | 4C | 3.8 [pL] | S6 | 10% |

| PRINTING CONDITION | | REFERENCE DRYING INTENSITY |
|---|---|---|
| TYPE OF UV VANISH | VARNISH A | 8 |
| THE TYPE OF A SHEET | SHEET A | |
| THICKNESS OF A SHEET | 0.38mm | |
| PRINTING SURFACE | SURFACE | |

| | | |
|---|---|---|
| IMAGE | COLOR | C/M/Y |
| | AMOUNT OF INK | 3.0pL |

FIG. 11

CORRECTION CONDITION CORRESPONDING TO COLOR

| COLOR | AMOUNT OF CORRECTION |
|---|---|
| K | −2 |
| C | 0 |
| M | 0 |
| Y | 0 |
| R | 0 |
| G | 0 |
| B | 0 |
| 4C | −2 |
| 3C | −2 |

FIG. 12

CORRECTION CONDITION CORRESPONDING TO AMOUNT OF INK

| AMOUNT OF INK | AMOUNT OF CORRECTION |
|---|---|
| $V<1.0$ | −2 |
| $1.0\leqq V<2.0$ | −2 |
| $2.0\leqq V<2.5$ | −1 |
| $2.5\leqq V<3.0$ | 0 |
| $3.0\leqq V<3.5$ | 0 |
| $3.5\leqq V<4.0$ | +1 |
| $4.0\leqq V<4.5$ | +1 |
| $4.5\leqq V<5.0$ | +2 |
| $5.0\leqq V<5.5$ | +2 |
| $5.5\leqq V$ | +3 |

FIG. 15

| REGION | DRAWING CONDITION | | CORRECTION CONDITION | | INDIVIDUAL DRYING INTENSITY |
|---|---|---|---|---|---|
| | COLOR | AMOUNT OF INK | COLOR | AMOUNT OF INK | |
| A1 | K | 3.5 [pL] | −2 | +1 | 7 |
| A2 | C | 0.8 [pL] | 0 | −2 | 6 |
| A3 | M | 2.0 [pL] | 0 | −1 | 7 |
| A4 | R | 2.4 [pL] | 0 | −1 | 7 |
| A5 | B | 4.4 [pL] | 0 | +1 | 9 |
| A6 | 4C | 3.8 [pL] | −2 | +1 | 7 |

REFERENCE DRYING INTENSITY: 8

| REGION | INDIVIDUAL DRYING INTENSITY | OCCUPIED AREA | AREA OCCUPANCY |
|---|---|---|---|
| A1 | 7 | S1 | 10% |
| A2 | 6 | S2 | 8% |
| A3 | 7 | S3 | 40% |
| A4 | 7 | S4 | 2% |
| A5 | 9 | S5 | 30% |
| A6 | 7 | S6 | 10% |

| INDIVIDUAL DRYING INTENSITY | OCCUPIED AREA | AREA OCCUPANCY |
|---|---|---|
| 6 | S2 | 8% |
| 7 | S1+S3+S4+S6 | 62% |
| 9 | S5 | 30% |

| REGION | DRAWING CONDITION | | INDIVIDUAL DRYING INTENSITY | OCCUPIED AREA | AREA OCCUPANCY |
|---|---|---|---|---|---|
| | COLOR | AMOUNT OF INK | | | |
| B1 | K | 3.4 [pL] | 6 | Sb1 | 14% |
| B2 | K | 3.3 [pL] | 6 | Sb2 | 14% |
| B3 | K | 3.2 [pL] | 6 | Sb3 | 14% |
| B4 | K | 3.1 [pL] | 6 | Sb4 | 14% |
| B5 | K | 3.0 [pL] | 6 | Sb5 | 14% |
| B6 | B | 5.0 [pL] | 10 | Sb6 | 30% |

FIG. 25

INCLUDING WAX
COLOR: 4C

| TEMPERATURE WHERE SHEET REACHES [°C] | ADHESIVENESS | GLOSSINESS | BLOCKING | DEFORMATION OF SHEET |
|---|---|---|---|---|
| 43 | A | C | C | A |
| 53 | A | C | B | A |
| 63 | A | B | A | A |
| 74 | A | A | A | A |
| 83 | A | A | A | A |
| 94 | B | A | A | A |
| 105 | C | A | A | B |
| 115 | C | A | A | C |
| 125 | C | A | A | C |
| 135 | C | A | A | C |

FIG. 26

INCLUDING WAX
COLOR: BLUE

| TEMPERATURE WHERE SHEET REACHES [°C] | ADHESIVENESS | GLOSSINESS | BLOCKING | DEFORMATION OF SHEET |
|---|---|---|---|---|
| 44 | A | C | C | A |
| 52 | A | C | B | A |
| 60 | A | B | B | A |
| 67 | A | B | B | A |
| 75 | A | A | A | A |
| 83 | A | A | A | A |
| 91 | B | A | A | A |
| 99 | C | A | A | A |
| 107 | C | A | A | B |
| 115 | C | A | A | C |

FIG. 27

NOT INCLUDING WAX
COLOR: 4C

| TEMPERATURE WHERE SHEET REACHES [°C] | ADHESIVENESS | GLOSSINESS | BLOCKING | DEFORMATION OF SHEET |
|---|---|---|---|---|
| 43 | A | C | C | A |
| 53 | A | C | B | A |
| 63 | A | B | A | A |
| 74 | A | A | A | A |
| 83 | A | A | A | A |
| 94 | A | A | A | A |
| 105 | A | A | A | B |
| 115 | A | A | A | C |
| 125 | A | A | A | C |
| 135 | A | A | A | C |

FIG. 28

NOT INCLUDING WAX
COLOR: BLUE

| TEMPERATURE WHERE SHEET REACHES [°C] | ADHESIVENESS | GLOSSINESS | BLOCKING | DEFORMATION OF SHEET |
|---|---|---|---|---|
| 44 | A | C | C | A |
| 52 | A | C | B | A |
| 60 | A | B | B | A |
| 67 | A | B | B | A |
| 75 | A | A | A | A |
| 83 | A | A | A | A |
| 91 | A | A | A | A |
| 99 | A | A | A | A |
| 107 | A | A | A | B |
| 115 | A | A | A | C |

FIG. 29

INCLUDING WAX
COLOR: 4C

| | DRYING INTENSITY | TRANSPORT SPEED OF SHEET [mm/s] | TEMPERATURE WHERE SHEET REACHES [°C] | ADHESIVENESS | GLOSSINESS | BLOCKING | DEFORMATION OF SHEET |
|---|---|---|---|---|---|---|---|
| LEVEL 1 | 4 | 535 | 74 | A | A | A | A |
| LEVEL 2 | 5 | 535 | 83 | A | A | A | A |
| LEVEL 3 | 8 | 535 | 115 | C | A | A | C |
| LEVEL 4 | 10 | 535 | 135 | C | A | A | C |
| LEVEL 5 | 4 | 270 | 78 | A | A | A | A |
| LEVEL 6 | 5 | 270 | 84 | A | A | A | A |

FIG. 30

INCLUDING WAX
COLOR: BLUE

| | DRYING INTENSITY | TRANSPORT SPEED OF SHEET [mm/s] | TEMPERATURE WHERE SHEET REACHES [°C] | ADHESIVENESS | GLOSSINESS | BLOCKING | DEFORMATION OF SHEET |
|---|---|---|---|---|---|---|---|
| LEVEL 1 | 4 | 535 | 67 | A | B | B | A |
| LEVEL 2 | 5 | 535 | 75 | A | A | A | A |
| LEVEL 3 | 8 | 535 | 99 | C | A | A | A |
| LEVEL 4 | 10 | 535 | 115 | C | A | A | C |
| LEVEL 5 | 4 | 270 | 69 | A | A | A | A |
| LEVEL 6 | 5 | 270 | 75 | A | A | A | A |

INK JET PRINTING APPARATUS AND DRYING INTENSITY SETTING METHOD THEREOF

CROSS-REFERENCE TO RELATED APPLICATIONS

The present application claims priority under 35 U.S.C. § 119 to Japanese Patent Application No. 2016-191283, filed on Sep. 29, 2016. The above application is hereby expressly incorporated by reference, in its entirety, into the present application.

BACKGROUND OF THE INVENTION

1. Field of the Invention

The present invention relates to an ink jet printing apparatus and a drying intensity setting method thereof; and more particularly, to an ink jet printing apparatus that dries ink by heating a sheet after printing an image with aqueous ink and performs UV varnish coating by applying UV varnish, and a drying intensity setting method thereof.

2. Description of the Related Art

Varnish coating is known as means for giving a high-quality feeling to a printed article. Varnish coating is to coat the surface of a printed article with varnish. Particularly, a case in which varnish coating is performed using UV varnish is referred to as UV varnish coating. UV varnish is varnish that is to be cured through the irradiation of ultraviolet (UV). UV varnish mainly contains a polymerizable monomer as a main component; and a photoinitiator contained in the UV varnish absorbs UV and generates radicals, so that the UV varnish forms a coated film through a polymerization reaction.

JP2015-164786A, JP2016-107419A, and the like disclosure ink jet printing apparatuses that dry ink by heating a sheet after printing an image with aqueous ink by an ink jet method and perform UV varnish coating in an in-line manner. Here, aqueous ink means ink in which a color material, such as dye or a pigment, is dissolved or dispersed in water and a solvent soluble in water. Further, an ink jet method means a marking method that includes separating ink in the form of liquid droplets, jetting the ink to a medium according to image signals, and making color materials adhere to the medium. Furthermore, the fact that UV varnish coating can be performed in an in-line manner means that UV varnish coating can be performed in a printing apparatus.

SUMMARY OF THE INVENTION

However, if appropriate drying intensity is not set during processing for drying ink after printing in a case in which a printed article, which has been subjected to printing using aqueous ink by an ink jet method, is to be subjected to UV varnish coating, there is a drawback that deformation, such as curl or cockle, occurs on the printed article, the gloss of varnish deteriorates, the adhesiveness of varnish deteriorates, or blocking (a phenomenon in which overlapping sheets stick to each other) occurs. Specifically, since the temperature of a sheet is too high in a case in which drying intensity is set too high, deformation, such as curl or cockle, occurs on the sheet or the adhesiveness of varnish deteriorates. On the other hand, since a solvent of ink is mixed to UV varnish in a case in which drying intensity is set too low, the gloss of varnish deteriorates or blocking occurs during the collection of sheets. "Curl" means a phenomenon in which an end of a sheet rises. "Cockle" is also referred to as "cockling" or "flapping", and means a phenomenon in which the surface of a sheet is finely wrinkled.

The invention has been made in consideration of the above-mentioned circumstances, and an object of the invention is to provide an ink jet printing apparatus that can appropriately set drying intensity and a drying intensity setting method thereof.

Means for achieving the above-mentioned object are as follows.

(1) An ink jet printing apparatus comprising: a printing section that prints an image on a sheet with aqueous ink by an ink jet method; an ink drying section that dries the ink by heating the sheet having been subjected to printing; a drying intensity setting section that sets drying intensity of the ink drying section and sets the drying intensity to intensity in which temperature where the sheet reaches is in a prescribed range; and a varnish coating section that coats the sheet of which the ink has been dried with ultraviolet (UV) varnish, in which the drying intensity setting section includes a region extracting unit that analyzes an image to be printed on the sheet and extracts regions corresponding to the same drawing conditions prescribed by colors and the amount of ink, a drawing condition-occupied area calculating unit that calculates occupied areas corresponding to the respective drawing conditions, a maximum occupied area-drawing condition selecting unit that selects a drawing condition corresponding to the maximum occupied area, and a drying intensity calculating unit that obtains a correction condition corresponding to the drawing condition, which is selected by the maximum occupied area-drawing condition selecting unit, with reference to correction conditions prescribed for the respective drawing conditions and calculates drying intensity by correcting reference drying intensity with the obtained collection condition, and the drying intensity calculated by the drying intensity calculating unit is set as the drying intensity of the ink drying section.

According to this aspect, drying intensity in a case in which the ink is dried is set by the drying intensity setting section. Drying intensity is the degree of intensity of drying. The drying intensity setting section sets drying intensity on the basis of the image to be printed so that the temperature where the sheet reaches is in the prescribed range. The temperature where the sheet reaches is the maximum temperature where the sheet reaches through the heating of the sheet. The setting of drying intensity is performed as follows. First, an image to be printed on the sheet is analyzed, and regions corresponding to the same drawing conditions, which are prescribed by colors and the amount of ink, are extracted. Next, an occupied area corresponding to each drawing condition is calculated. That is, a total area of the regions corresponding to the same drawing condition is obtained, and a ratio of a total of the regions to the entire region is calculated. The entire region is a region set as a printable region. Next, a drawing condition corresponding to the maximum occupied area is selected. Then, a collection condition corresponding to the drawing condition corresponding to the maximum occupied area is obtained with reference to correction conditions prescribed for the respective drawing conditions. After that, drying intensity is calculated through the collection of the reference drying intensity performed with the obtained correction condition. That is, drying intensity serving as a reference (reference drying intensity) is prescribed in advance, and drying intensity to be set in the ink drying section is determined through the correction of the drying intensity serving as a reference (reference drying intensity). In this case, drying intensity is determined through the application of the correction of the drawing condition corresponding to the maximum occupied area. Accordingly, drying intensity can be appropriately set even in a case in which regions corresponding to different drawing conditions are present.

(2) The ink jet printing apparatus according to (1), in which the drying intensity setting section further includes an individual drying intensity calculating unit that calculates drying intensity for each drawing condition by correcting the reference drying intensity with the correction condition prescribed for each drawing condition, a drying intensity-occupied area calculating unit that groups drawing conditions corresponding to the same drying intensities and calculates occupied areas for the respective drying intensities, a maximum occupied area-drying intensity selecting unit that selects drying intensity corresponding to the maximum occupied area, and a drying intensity changing unit that compares the drying intensity, which is calculated by the drying intensity calculating unit, with the drying intensity, which is selected by the maximum occupied area-drying intensity selecting unit, and changes drying intensity, which is to be set in the ink drying section, to the drying intensity selected by the maximum occupied area-drying intensity selecting unit in a case in which the drying intensity calculated by the drying intensity calculating unit is different from the drying intensity selected by the maximum occupied area-drying intensity selecting unit.

According to this aspect, drying intensity to be set in the ink drying section is changed in a case in which drying intensity calculated as the drying intensity, which is to be set in the ink drying section, by the drying intensity calculating unit is different from drying intensity having the maximum occupied area. Specifically, the drying intensity is changed as described below. First, drying intensity is calculated for each drawing condition. The drying intensity corresponding to each drawing condition is calculated through the correction of reference drying intensity performed with the correction condition prescribed for each drawing condition. Next, drawing conditions corresponding to the same drying intensities are grouped and occupied areas are calculated for the respective drying intensities. That is, drawing conditions corresponding to the same drying condition are combined, the sum of the occupied areas thereof is obtained, and the occupied areas corresponding to the respective drying intensities are calculated. Next, drying intensity having the maximum occupied area among the occupied areas corresponding to the obtained drying intensities is selected. Then, the selected drying intensity and the drying intensity, which is calculated by the drying intensity calculating unit, are compared with each other. In a case in which the drying intensity calculated by the drying intensity calculating unit is different from the selected drying intensity, drying intensity to be set in the ink drying section is changed to the selected drying intensity and the drying intensity having the maximum occupied area. That is, the drying intensity to be set in the ink drying section is changed to the drying intensity of a region having the maximum occupied area among the regions that are set to the same drying intensities. Accordingly, drying intensity can be more appropriately set.

(3) An ink jet printing apparatus comprising: a printing section that prints an image on a sheet with aqueous ink by an ink jet method; an ink drying section that dries the ink by heating the sheet having been subjected to printing; a drying intensity setting section that sets drying intensity of the ink drying section and sets the drying intensity to intensity in which temperature where the sheet reaches is in a prescribed range; and a varnish coating section that coats the sheet of which the ink has been dried with UV varnish, in which the drying intensity setting section includes a region extracting unit that analyzes an image to be printed on the sheet and extracts regions corresponding to the same drawing conditions prescribed by colors and the amount of ink, a drawing condition-occupied area calculating unit that calculates occupied areas corresponding to the respective drawing conditions, an individual drying intensity calculating unit that calculates drying intensity for each drawing condition by correcting reference drying intensity with a correction condition prescribed for each drawing condition, a drying intensity-occupied area calculating unit that groups drawing conditions corresponding to the same drying intensities and calculates occupied areas for the respective drying intensities, and a maximum occupied area-drying intensity selecting unit that selects drying intensity corresponding to the maximum occupied area, and the drying intensity selected by the maximum occupied area-drying intensity selecting unit is set as the drying intensity of the ink drying section.

According to this aspect, drying intensity in a case in which the ink is dried is set by the drying intensity setting section. The drying intensity setting section sets drying intensity on the basis of the image to be printed so that the temperature where the sheet reaches is in the prescribed range. Specifically, drying intensity is set as described below. First, an image to be printed on the sheet is analyzed, and regions corresponding to the same drawing conditions, which are prescribed by colors and the amount of ink, are extracted. Next, an occupied area corresponding to each drawing condition is calculated. Then, drying intensity is calculated for each drawing condition. Next, drawing conditions corresponding to the same drying intensities are grouped and occupied areas are calculated for the respective drying intensities. After that, drying intensity corresponding to the maximum occupied area is selected. The selected drying intensity is set as the drying intensity of the ink drying section. That is, drying intensity to be set in the ink drying section is set as the drying intensity of a region having the maximum occupied area among the regions that are to be set to the same drying intensities. Accordingly, drying intensity can be appropriately set.

(4) The ink jet printing apparatus according to (2) or (3) further comprising: a lowest-drying-intensity selecting unit that selects the lowest drying intensity among the drying intensities calculated for the respective drawing conditions; a highest-drying-intensity selecting unit that selects the highest drying intensity among the drying intensities calculated for the respective drawing conditions; a drying intensity-change-instruction receiving unit that receives an instruction for changing drying intensity to the lowest drying intensity or the highest drying intensity; and a forcibly-drying intensity-changing unit that forcibly changes drying intensity, which is to be set in the ink drying section, according to the received instruction in a case in which the drying intensity-change-instruction receiving unit receives the instruction for changing drying intensity.

According to this aspect, automatically set drying intensity can be manually changed. In this case, the automatically set drying intensity can be changed to the lowest level or the highest level. The lowest level is the lowest drying intensity among the drying intensities that are calculated for the respective drawing conditions. The highest level is the highest drying intensity among the drying intensities that are calculated for the respective drawing conditions. Accordingly, a user's demand can be appropriately reflected. For example, it is preferable that drying intensity is set as low as possible in a case in which the adhesiveness of varnish is regarded as most important. On the other hand, it is preferable that drying intensity is set as high as possible in a case in which the gloss of varnish is regarded as most important. Since drying intensity can be forcibly changed according to an instruction from a user in this way, a user's demand can be appropriately reflected.

(5) The ink jet printing apparatus according to any one of (1) to (4) further comprising: a set-intensity-display unit that displays drying intensity to be set in the ink drying section; a drying-intensity-correction-instruction receiving unit that receives an instruction for correcting drying intensity to be set in the ink drying section; and a drying intensity correcting unit that corrects drying intensity, which is to be set in the ink drying section, according to the received instruction in a case in which the drying-intensity-correction-instruction receiving unit receives the instruction for correcting drying intensity.

According to this aspect, drying intensity to be set in the ink drying section can be manually corrected. Drying intensity to be set in the ink drying section is displayed on the set-intensity-display unit. A user looks at the display of the set-intensity-display unit and can determine whether or not drying intensity needs to be corrected.

(6) The ink jet printing apparatus according to any one of (1) to (5), in which the region extracting unit excludes a region, which is smaller than a certain area, from an object and extracts the regions corresponding to the same drawing conditions.

According to this aspect, in a case in which regions corresponding to the same drawing condition are extracted, a region smaller than a certain area is excluded from an object to be extracted and regions are extracted. Accordingly, an object to be processed can be appropriately extracted. Therefore, a load of processing can be reduced.

(7) The ink jet printing apparatus according to any one of (1) to (6), in which the ink drying section includes a sheet transport unit that transports the sheet, and a heating unit that is disposed on a transport path of the sheet transported by the sheet transport unit.

According to this aspect, the ink drying section includes the sheet transport unit and the heating unit. In this case, drying intensity is set as the heating intensity of the heating unit that heats a sheet (the degree of intensity of the heating of a sheet).

(8) The ink jet printing apparatus according to (7) further comprising: a determination unit that determines whether or not a region in which temperature where the sheet reaches exceeds the prescribed range is present in a case in which the ink drying section is operated at set drying intensity; and a correction unit that corrects a transport speed of the sheet and drying intensity of the heating unit in a case in which the region in which the temperature where the sheet reaches exceeds the prescribed range is present.

According to this aspect, it is determined whether or not a region in which temperature where the sheet reaches exceeds the prescribed range is present in a case in which the ink drying section is operated at set drying intensity. The transport speed of the sheet and the drying intensity of the heating unit are corrected in a case in which the region in which the temperature where the sheet reaches exceeds the prescribed range is present. In this case, the transport speed of the sheet and the drying intensity of the heating unit are corrected so that an equivalent drying rate is obtained. Specifically, the transport speed of the sheet is reduced and the drying intensity of the heating unit is reduced. That is, the same amount of heat is applied but a rise in the temperature of the sheet is suppressed. Accordingly, it is possible to prevent the temperature where the sheet reaches from exceeding the prescribed range over the entire sheet.

(9) The ink jet printing apparatus according to any one of (1) to (8), in which in a case in which a lower limit of temperature at which the deterioration of the gloss of UV varnish is capable of being prevented and blocking is capable of being prevented is denoted by T1 and an upper limit of temperature at which the deterioration of the adhesiveness of UV varnish is capable of being prevented and the deformation of the sheet is capable of being prevented is denoted by T2, the prescribed range of the temperature where the sheet reaches is set to the range of T1 to T2.

According to this aspect, the drying intensity of the ink drying section is set so that the temperature where a sheet reaches is in the range of T1 to T2. Here, T1 denotes the lower limit of temperature at which the deterioration of the gloss of UV varnish can be prevented and blocking can be prevented. Further, T2 denotes the upper limit of temperature at which the deterioration of the adhesiveness of UV varnish can be prevented and the deformation of a sheet can be prevented. Accordingly, the deterioration of the gloss of UV varnish can be prevented in a case in which UV varnish coating is performed. Further, blocking can be prevented and the deformation of a sheet can be prevented.

"The deterioration of the gloss of UV varnish can be prevented" means that the deterioration of the gloss can be prevented in an allowable range. Likewise, "blocking can be prevented" means that blocking can be prevented in an allowable range. Further, "the deterioration of the adhesiveness of UV varnish can be prevented" means that the deterioration of the adhesiveness can be prevented in an allowable range. Further, "the deformation of a sheet can be prevented" means that the deformation of a sheet can be prevented in an allowable range.

(10) The ink jet printing apparatus according to any one of (1) to (9) further comprising: a reference drying intensity setting section that sets the reference drying intensity on the basis of a printing condition.

According to this aspect, the reference drying intensity is set on the basis of a printing condition. Accordingly, the reference drying intensity can be more appropriately set. For example, the reference drying intensity is set depending on the type of UV varnish, the type of the sheet, the thickness of the sheet, the distinction of a printing surface, or the like. The distinction of a printing surface is the distinction of whether printing is surface printing or back printing.

(11) A drying intensity setting method of setting drying intensity of an ink drying section in an ink jet printing apparatus including a printing section that prints an image on a sheet with aqueous ink by an ink jet method, an ink drying section that dries the ink by heating the sheet having been subjected to printing, and a varnish coating section that coats the sheet of which the ink has been dried with UV varnish, the method comprising: a step of analyzing an image to be printed on the sheet and extracting regions corresponding to the same drawing conditions prescribed by colors and the amount of ink; a step of calculating occupied areas corresponding to the respective drawing conditions; a step of selecting a drawing condition corresponding to the maximum occupied area; a step of obtaining a correction condition corresponding to the drawing condition corresponding to the maximum occupied area with reference to correction conditions prescribed for the respective drawing conditions and calculating drying intensity by correcting reference drying intensity with the obtained correction condition; and a step of setting the calculated drying intensity as the drying intensity of the ink drying section, in which the calculated drying intensity is set as the drying intensity of the ink drying section.

According to this aspect, drying intensity is set so that the temperature where the sheet reaches is in the prescribed range in a case in which ink is to be dried. Specifically, drying intensity is set as described below. First, an image to be printed on the sheet is analyzed, and regions corresponding to the same drawing conditions, which are prescribed by colors and the amount of ink, are extracted. Next, an occupied area corresponding to each drawing condition is calculated. That is, a total area of the regions corresponding to the same drawing condition is obtained, and a ratio of a total of the regions to the entire region is calculated. Then, a correction condition corresponding to the drawing condition corresponding to the maximum occupied area is obtained with reference to the correction conditions prescribed for the respective drawing conditions. After that, drying intensity is calculated through the correction of the reference drying intensity performed with the obtained correction condition. That is, drying intensity serving as a reference (reference drying intensity) is prescribed in advance, and drying intensity to be set in the ink drying section is determined through the correction of the drying intensity serving as a reference (reference drying intensity). In this case, drying intensity is determined through the application of the correction of the drawing condition corresponding to the maximum occupied area. Accordingly, drying intensity can be appropriately set even in a case in which regions corresponding to different drawing conditions are present.

(12) The drying intensity setting method of an ink jet printing apparatus according to (11) further comprising: a step of calculating drying intensity for each drawing condition by correcting the reference drying intensity with the correction condition prescribed for each drawing condition; a step of grouping drawing conditions corresponding to the same drying intensities and calculating occupied areas for the respective drying intensities; and a step of selecting drying intensity corresponding to the maximum occupied area, in which drying intensity to be set in the ink drying section is corrected to the drying intensity corresponding to the maximum occupied area in a case in which the calculated drying intensity is different from the drying intensity corresponding to the maximum occupied area.

According to this aspect, drying intensity to be set in the ink drying section is changed in a case in which drying intensity calculated as the drying intensity, which is to be set in the ink drying section, is different from drying intensity having the maximum occupied area. Specifically, the drying intensity is changed as described below. First, drying intensity is calculated for each drawing condition. The drying intensity corresponding to each drawing condition is calculated through the correction of reference drying intensity performed with the correction condition prescribed for each drawing condition. Next, drawing conditions corresponding to the same drying intensities are grouped and occupied areas are calculated for the respective drying intensities. That is, drawing conditions corresponding to the same drying condition are combined, the sum of the occupied areas thereof is obtained, and the occupied areas corresponding to the respective drying intensities are calculated. Next, drying intensity having the maximum occupied area among the occupied areas corresponding to the obtained drying intensities is selected. Then, the selected drying intensity and the drying intensity, which is calculated by the drying intensity calculating unit, are compared with each other. In a case in which the drying intensity calculated by the drying intensity calculating unit is different from the selected drying intensity, drying intensity to be set in the ink drying section is changed to the selected drying intensity and the drying intensity having the maximum occupied area. That is, the drying intensity to be set in the ink drying section is changed to the drying intensity of a region having the maximum occupied area among the regions that are set to the same drying intensities. Accordingly, drying intensity can be more appropriately set.

(13) A drying intensity setting method of setting drying intensity of an ink drying section in an ink jet printing apparatus including a printing section that prints an image on a sheet with aqueous ink by an ink jet method, an ink drying section that dries the ink by heating the sheet having been subjected to printing, and a varnish coating section that coats the sheet of which the ink has been dried with UV varnish, the method comprising: a step of analyzing an image to be printed on the sheet and extracting regions corresponding to the same drawing conditions prescribed by colors and the amount of ink; a step of calculating an occupied area corresponding to each drawing condition; a step of calculating drying intensity for each drawing condition by correcting reference drying intensity with a correction condition prescribed for each drawing condition; a step of grouping drawing conditions corresponding to the same drying intensities and calculating occupied areas for the respective drying intensities; and a step of selecting drying intensity corresponding to the maximum occupied area, in which the selected drying intensity is set as the drying intensity of the ink drying section.

According to this aspect, drying intensity is set so that the temperature where the sheet reaches is in the prescribed range in a case in which ink is to be dried. Specifically, drying intensity is set as described below. First, an image to be printed on the sheet is analyzed, and regions corresponding to the same drawing conditions, which are prescribed by colors and the amount of ink, are extracted. Next, an occupied area corresponding to each drawing condition is calculated. Then, drying intensity corresponding to each drawing condition is calculated. Next, drawing conditions corresponding to the same drying intensities are grouped and occupied areas are calculated for the respective drying intensities. After that, drying intensity corresponding to the maximum occupied area is selected. The selected drying intensity is set as the drying intensity of the ink drying section. That is, drying intensity to be set in the ink drying section is set as the drying intensity of a region having the maximum occupied area among the regions that are to be set to the same drying intensities. Accordingly, drying intensity can be appropriately set.

According to the invention, drying intensity can be appropriately set.

BRIEF DESCRIPTION OF THE DRAWINGS

FIG. 11 is a diagram showing an example of a table in which a correction condition corresponding to each color is prescribed.

FIG. 12 is a diagram showing an example of a table in which a correction condition corresponding to each of the amounts of ink is prescribed.

FIG. 15 is a table showing examples of the calculation result of drying intensity corresponding to each drawing condition (individual drying intensity).

FIG. 25 is a table of experimental results in a case in which an image of 4C is printed with ink including wax.

FIG. 26 is a table of experimental results in a case in which a blue image is printed with ink including wax.

FIG. 27 is a table of experimental results in a case in which an image of 4C is printed with ink not including wax.

FIG. 28 is a table of experimental results in a case in which a blue image is printed with ink not including wax.

FIG. 29 shows experimental results in a case in which an image of 4C is printed.

FIG. 30 shows experimental results in a case in which a blue image is printed.

DESCRIPTION OF THE PREFERRED EMBODIMENTS

Preferred embodiments of the invention will be described in detail below with reference to the accompanying drawings.

First Embodiment

Entire Structure of Ink Jet Printing Apparatus

Figure 1:
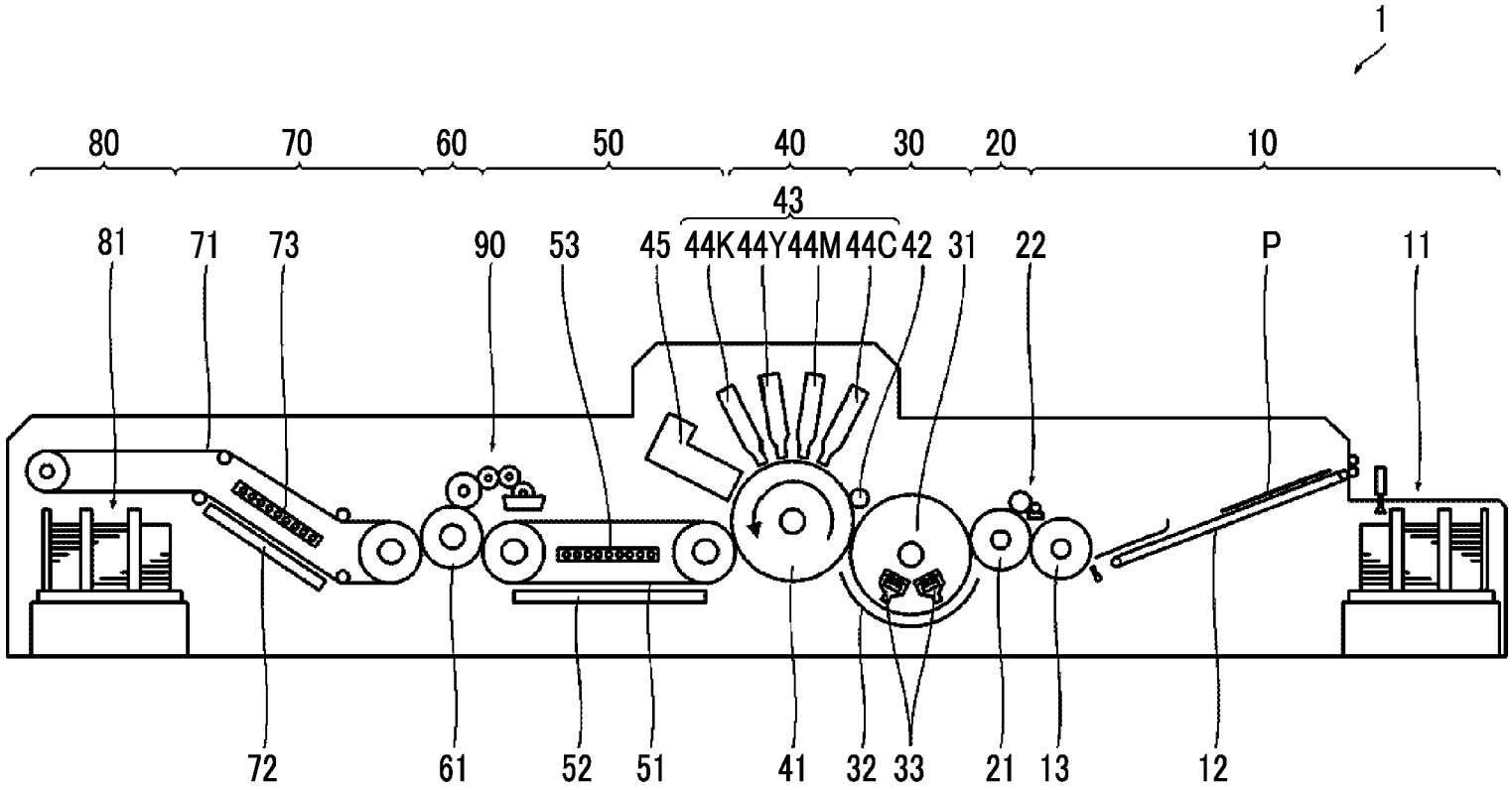
FIG. 1 is a diagram showing the entire structure of an ink jet printing apparatus according to an embodiment.

FIG. 1 is a diagram showing the entire structure of an ink jet printing apparatus according to an embodiment.

The ink jet printing apparatus 1 shown in FIG. 1 is a sheet-type color ink jet printing apparatus that prints a color image on a sheet as a sheet of paper with inks having four colors of cyan (C), magenta (M), yellow (Y), and black (K) by a single pass. Particularly, the ink jet printing apparatus 1 of this embodiment is an aqueous color ink jet printing apparatus that prints an image on a general-purpose printing sheet with aqueous ink. Further, the ink jet printing apparatus 1 of this embodiment is an ink jet printing apparatus that can coat a sheet with UV varnish in an in-line manner.

Here, the ink jet printing apparatus is a printing apparatus that prints an image by an ink jet method. An ink jet method means a marking method that includes separating ink in the form of liquid droplets, jetting the ink to a medium according to image signals, and making color materials adhere to the medium.

Further, the single pass means a method of completely printing an image on a sheet, which is being transported, in one shot while fixing an ink jet head at a certain position. The single pass is also referred to as one pass.

Furthermore, the general-purpose printing sheet does not mean so-called exclusive paper for an ink jet method and means a sheet, which uses cellulose as a main component, such as coated paper generally used in an offset printing machine and the like. For example, the general-purpose printing sheet includes art paper, coated paper, lightweight coated paper, cast paper, fine coated paper, and the like.

Further, aqueous ink means ink in which a color material, such as dye or a pigment, is dissolved or dispersed in water and a solvent soluble in water.

Furthermore, the fact that UV varnish coating can be performed in an in-line manner means that UV varnish coating can be performed in a printing apparatus. The UV varnish coating means that varnish coating is performed using UV varnish. UV varnish means varnish that is to be cured through the irradiation of ultraviolet (UV). UV varnish mainly contains a polymerizable monomer as a main component; and a photoinitiator contained in the UV varnish absorbs UV and generates radicals, so that the UV varnish forms a coated film through a polymerization reaction. Varnish coating means that the surface of a printed article is coated with varnish.

As shown in FIG. 1, the ink jet printing apparatus 1 includes: a sheet feeding section 10 that feeds a sheet P; a pre-coating section 20 that pre-coats the sheet P; a pre-coating liquid drying section 30 that dries pre-coating liquid by heating the pre-coated sheet P; a printing section 40 that prints an image on the sheet P, of which the pre-coating liquid has been dried, by an ink jet method; an ink drying section 50 that dries ink by heating the sheet P having been subjected to printing; a varnish coating section 60 that coats the sheet P, of which the ink has been dried, with UV varnish; a UV irradiation section 70 that cures the UV varnish by irradiating the sheet P, which has been subjected to varnish coating, with UV; and a collection section 80 that collects the sheet P.

Sheet Feeding Section

The sheet feeding section 10 feeds sheets one by one. As shown in FIG. 1, the sheet feeding section 10 mainly includes a sheet feeding device 11, a feeder board 12, and a sheet feeding drum 13.

The sheet feeding device 11 sequentially takes out sheets P, which are set on a tray in the form of a bundle, from the top of the bundle one by one and feeds the sheets P to the feeder board 12. The sheet feeding device 11 is provided with a blower (not shown) to stably feed sheets. The blower the sheets P by blowing air to the bundle of sheets. Since the flow rate of air to be blown from the blower can be adjusted, the flow rate of air is adjusted as necessary.

The feeder board 12 is means for transporting a sheet P, and receives the sheet P fed from the sheet feeding device 11 and transports the sheet P to the sheet feeding drum 13.

The sheet feeding drum 13 is means for transporting a sheet P, and receives the sheet P from the feeder board 12 and transports the sheet P along a fixed transport path. The sheet feeding drum 13 transports the sheet P while winding the sheet P around the peripheral surface thereof by rotating while gripping a front end of the sheet P by a gripper provided on the peripheral surface of the sheet feeding drum 13.

The sheet feeding section 10 has the above-mentioned structure. The sheets P are fed to the feeder board 12 from the sheet feeding device 11 one by one. Then, the sheets P are fed to the sheet feeding drum 13 by the feeder board 12, and are transported to the pre-coating section 20 by the sheet feeding drum 13.

Pre-Coating Section

The pre-coating section 20 pre-coats the sheet P. Pre-coating is performed to reliably hold ink droplets at landing positions. For this purpose, the pre-coating liquid is formed of liquid having a function to hold ink droplets at landing positions. Specifically, the pre-coating liquid is formed of liquid having a function to allow a color material component, which is contained in ink, to aggregate, to insolubilize the color material component, or to thicken the color material component. Since the pre-coating liquid is applied to the sheet P, a high-quality image can be printed even in a case in which an image is printed on a general-purpose printing sheet with aqueous ink.

As shown in FIG. 1, the pre-coating section 20 includes a pre-coating drum 21 that transports a sheet P, and a pre-coating liquid applying device 22 that applies the pre-coating liquid to the sheet P.

The pre-coating drum 21 receives the sheet P from the sheet feeding drum 13 and transports the received sheet P along a fixed transport path. The pre-coating drum 21 transports the sheet P while winding the sheet P around the peripheral surface thereof by rotating while gripping the front end of the sheet P by a gripper provided on the peripheral surface of the pre-coating drum 21.

The pre-coating liquid applying device 22 applies the pre-coating liquid to the printing surface of the sheet P, which is to be transported, by the pre-coating drum 21. The pre-coating liquid applying device 22 applies the pre-coating liquid to the sheet P by a roller. That is, the pre-coating liquid applying device 22 applies the pre-coating liquid to the sheet P by pressing an application roller, which the pre-coating liquid is applied to the peripheral surface thereof, against the printing surface of the sheet P. A method of applying the pre-coating liquid is not particularly limited, and an ink jet method, a spray method, and the like can also be employed as the method of applying the pre-coating liquid.

The pre-coating section 20 has the above-mentioned structure. The sheet P is delivered to the pre-coating drum 21 from the sheet feeding drum 13. The pre-coating drum 21 transports a sheet P along a fixed transport path. While the sheet P is transported, the pre-coating liquid is applied to the printing surface of the sheet P by the pre-coating liquid applying device 22.

Pre-Coating Liquid Drying Section

The pre-coating liquid drying section 30 dries the pre-coating liquid by heating the pre-coated sheet P. As shown in FIG. 1, the pre-coating liquid drying section 30 includes a pre-coating liquid drying drum 31 that transports a sheet P, a pre-coating liquid drying section-sheet guide 32 that guides the transport of the sheet P, and dryers 33 that blow hot air to the sheet P.

The pre-coating liquid drying drum 31 receives the sheet P from the pre-coating drum 21 and transports the received sheet P along a fixed transport path. The pre-coating liquid drying drum 31 transports the sheet P along a fixed transport path by rotating while gripping a front end of the sheet P by a gripper provided on the peripheral surface of the pre-coating liquid drying drum 31.

The pre-coating liquid drying section-sheet guide 32 guides the transport of the sheet P that is transported by the pre-coating liquid drying drum 31. The pre-coating liquid drying section-sheet guide 32 includes an arc-shaped guide surface. The sheet P slides on the guide surface of the pre-coating liquid drying section-sheet guide 32.

The dryers 33 heat the sheet P by blowing hot air to the sheet P that is transported by the pre-coating liquid drying drum 31. The dryers 33 blow hot air to the surface of the sheet P to which the pre-coating liquid is applied. For this reason, the dryers 33 are disposed in the pre-coating liquid drying drum 31. Each of the dryers 33 includes, for example, a heat source, such as a halogen heater or an infrared (IR) heater, and blast means, such as a fan or a blower, for sending air heated by the heat source. In a case in which the dryer 33 includes the heater and the fan, the heating intensity of the dryer is adjusted depending on the number of times of turning-on of the heater and/or a turn-on duty ratio.

The pre-coating liquid drying section 30 has the above-mentioned structure. The sheet P is delivered to the pre-coating liquid drying drum 31 from the pre-coating drum 21. The pre-coating liquid drying drum 31 transports the sheet P along a fixed transport path. While the sheet P is transported, hot air is blown to the surface of the sheet P, to which the pre-coating liquid is applied, from the dryers 33. Accordingly, the sheet P is heated, so that a solvent component of the pre-coating liquid applied to the sheet P is dried and removed.

Printing Section

The printing section 40 prints an image on the sheet P with inks having four colors of cyan (C), magenta (M), yellow (Y), and black (K).

As shown in FIG. 1, the printing section 40 includes: a printing drum 41 that transports a sheet P; a sheet pressing roller 42 that presses the sheet P transported by the printing drum 41 against the printing drum 41; a printing unit 43 that prints an image on the sheet P transported by the printing drum 41 with inks having four colors of cyan (C), magenta (M), yellow (Y), and black (K) by an ink jet method; and an image reading device 45 that reads the image printed on the sheet P.

The printing drum 41 is means for transporting a sheet P in the printing section 40, and receives the sheet P from the pre-coating liquid drying drum 31 of the pre-coating liquid drying section 30 and transports the sheet P to the ink drying section 50. The printing drum 41 transports the sheet P while winding the sheet P around the peripheral surface thereof by rotating while gripping a front end of the sheet P by a gripper provided on the peripheral surface of the printing drum 41. The printing drum 41 is provided with a suction mechanism (not shown) to particularly ensure close contact between the sheet P and itself. The suction mechanism employs a method using negative pressure, a method using static electricity, and the like. In the method using negative pressure, small holes are formed on the peripheral surface of the drum and a sheet is made to be in close contact with the peripheral surface of the drum by the suction of air from the inside of the drum. In the method using static electricity, a sheet is made to be in close contact with the peripheral surface of the drum by the electrification of the peripheral surface of the drum.

The sheet pressing roller 42 is disposed on the transport path of a sheet P that is transported by the printing drum 41. Particularly, the sheet pressing roller 42 is disposed on the upstream side of the printing unit 43 in the transport direction of the sheet P. The sheet pressing roller 42 is means for pressing a sheet P, and makes the sheet P be in close contact with the peripheral surface of the printing drum 41 by pressing the sheet P, which is transported by the printing drum 41, against the printing drum 41.

The printing unit 43 is disposed on the transport path of a sheet P that is transported by the printing drum 41. The printing unit 43 includes an ink jet head 44C that jets ink droplets having a cyan (C) color, an ink jet head 44M that jets ink droplets having a magenta (M) color, an ink jet head 44Y that jets ink droplets having a yellow (Y) color, and an ink jet head 44K that jets ink droplets having a black (K) color. The respective ink jet heads 44C, 44M, 44Y, and 44K are mounted on a carriage (not shown), and are integrated with the carriage.

Each of the ink jet heads 44C, 44M, 44Y, and 44K is formed of a line head that can print an image on the sheet P transported by the printing drum 41 by a single pass.

The respective ink jet heads 44C, 44M, 44Y, and 44K are mounted on the carriage (not shown), so that the respective ink jet heads are disposed orthogonal to the transport direction of the sheet P.

Further, the respective ink jet heads 44C, 44M, 44Y, and 44K are mounted on the carriage (not shown), so that the ink jet heads are arranged at regular intervals in the transport direction of the sheet P. In the embodiment shown in FIG. 1, the respective ink jet heads 44C, 44M, 44Y, and 44K are arranged at regular intervals in the order of cyan, magenta, yellow, and black from the upstream side in the transport direction of the sheet P.

The carriage (not shown) is provided so as to be movable in a direction parallel to the axis of rotation of the printing drum 41. Accordingly, the printing unit 43 can be retreated from the printing drum by the movement of the carriage.

Each of the ink jet heads 44C, 44M, 44Y, and 44K mounted on the carriage (not shown) is disposed so that a nozzle surface provided on the tip of each ink jet head faces the peripheral surface of the printing drum 41. A plurality of nozzles are disposed on the nozzle surface, and ink droplets are jetted to the sheet P from the nozzles. For example, the nozzles are disposed in the form of a matrix. Since the nozzles are disposed in the form of a matrix, the nozzles can be densely disposed in comparison with a case in which nozzles are disposed in line.

Each of the ink jet heads 44C, 44M, 44Y, and 44K can jet ink droplets having a plurality of sizes (volumes) from the nozzles. In this embodiment, each of the ink jet heads can jet large ink droplets and small ink droplets. The large ink droplet is a liquid droplet of which the volume is, for example, 6.7 pL, and the small ink droplet is a liquid droplet of which the volume is, for example, 2.2 pL (pL: picoliter, 1 L=1000 $cm^3$).

The image reading device 45 is disposed on the transport path of a sheet P that is transported by the printing drum 41. The image reading device 45 is disposed on the downstream side of the printing unit 43 in the transport direction of the sheet P to read the results of printing that is performed by the printing unit 43. The image reading device 45 is formed of a line scanner, and reads the sheet, which is transported by the printing drum 41, line by line.

The printing section 40 has the above-mentioned structure. The sheet P is delivered to the printing drum 41 from the pre-coating liquid drying drum 31. The printing drum 41 transports the sheet P along a fixed transport path. While the sheet P is transported, inks having the respective colors are jetted from the ink jet heads 44C, 44M, 44Y, and 44K and an image is printed on the printing surface. The printed image is read by the image reading device 45 as necessary.

Ink Drying Section

The ink drying section 50 dries ink by heating the sheet P having been subjected to printing. As shown in FIG. 1, the ink drying section 50 includes an ink drying section-chain delivery 51 that transports a sheet P, an ink drying section-sheet guide 52 that guides the sheet P transported by the ink drying section-chain delivery 51, and a heating device 53 that heats the sheet P transported by the ink drying section-chain delivery 51.

The ink drying section-chain delivery 51 receives the sheet P from the printing drum 41 and transports the received sheet P along a fixed transport path. The ink drying section-chain delivery 51 is an example of a sheet transport unit. The ink drying section-chain delivery 51 includes a pair of endless chains that travels along a fixed travel path, and grips front ends of sheets P by grippers laid on the pair of chains and transports the sheets P.

The ink drying section-sheet guide 52 guides the travel of the sheet P that is transported by the ink drying section-chain delivery 51. The ink drying section-sheet guide 52 includes a flat guide surface that is disposed along the transport path of the sheet P. The guide surface is provided with a plurality of suction holes. The sheet P, which is transported by the ink drying section-chain delivery 51, slides on the guide surface while air is sucked from the suction holes of the guide surface. Accordingly, the sheet P can be transported while tension is applied to the sheet P.

The heating device 53 dries ink by heating the sheet P that is transported by the ink drying section-chain delivery 51. The heating device 53 is an example of a heating unit. The heating device 53 has, for example, a structure in which a plurality of rod-like heaters are arranged at regular intervals in the transport direction of a sheet. Each of the heaters is disposed orthogonal to the transport direction of the sheet P. For example, a halogen heater, an IR heater, and the like are used as the heater. The drying intensity of the heating device 53 is adjusted depending on the number of heaters turned on and/or a turn-on duty ratio. In the ink jet printing apparatus 1 of this embodiment, an IR heater is used as the heater and drying intensity is adjusted depending on the turn-on duty ratio (duty (%)) of the heater.

Drying intensity is the degree of intensity of drying. Drying intensity is set as a numerical value in the range of, for example, 0 to 10, and is set at an interval of 1. 10 means the maximum intensity, and 0 means that the heating device is turned off.

As described below, the drying intensity, which is to be set in the heating device 53, is set so that temperature where the sheet P reaches is in a prescribed range. In a case in which the lower limit of temperature at which the deterioration of the gloss of UV varnish can be prevented and blocking can be prevented is denoted by T1 and the upper limit of temperature at which the deterioration of the adhesiveness of UV varnish can be prevented and the deformation of a sheet P can be prevented is denoted by T2, the prescribed range is set in the range of T1 to T2. Accordingly, in a case in which UV varnish coating is to be performed, the deterioration of the gloss of UV varnish can be prevented, blocking can be prevented, and the deformation of a sheet P can be prevented. A drying intensity setting method will be described in detail below.

"The deterioration of the gloss of UV varnish can be prevented" means that the deterioration of the gloss can be prevented in an allowable range. Likewise, "blocking can be prevented" means that blocking can be prevented in an allowable range. Further, "the deterioration of the adhesiveness of UV varnish can be prevented" means that the deterioration of the adhesiveness can be prevented in an allowable range. Further, "the deformation of a sheet can be prevented" means that the deformation of a sheet can be prevented in an allowable range.

The ink drying section 50 has the above-mentioned structure. The sheet P is delivered to the ink drying section-chain delivery 51 from the printing drum 41. The ink drying section-chain delivery 51 transports the sheet P along a fixed transport path. While the sheet P is transported, the sheet P is heated by the heating device 53 and ink is dried. That is, a solvent component of ink is dried and removed.

Varnish Coating Section

The varnish coating section 60 performs varnish coating by applying varnish to the surface of the image of the sheet P. Particularly, in the ink jet printing apparatus 1 of this embodiment, the varnish coating section 60 performs UV varnish coating by applying UV varnish. As shown in FIG. 1, the varnish coating section 60 includes a varnish coating drum 61 that transports a sheet P, and a varnish coater 90 that applies varnish to the surface of the image of the sheet P transported by the varnish coating drum 61.

The varnish coating drum 61 receives the sheet P from the ink drying section-chain delivery 51 and transports the received sheet P along a fixed transport path. The varnish coating drum 61 transports the sheet P while winding the sheet P around the peripheral surface thereof by rotating while gripping a front end of the sheet P by a gripper provided on the peripheral surface of the varnish coating drum 61.

Figure 2:
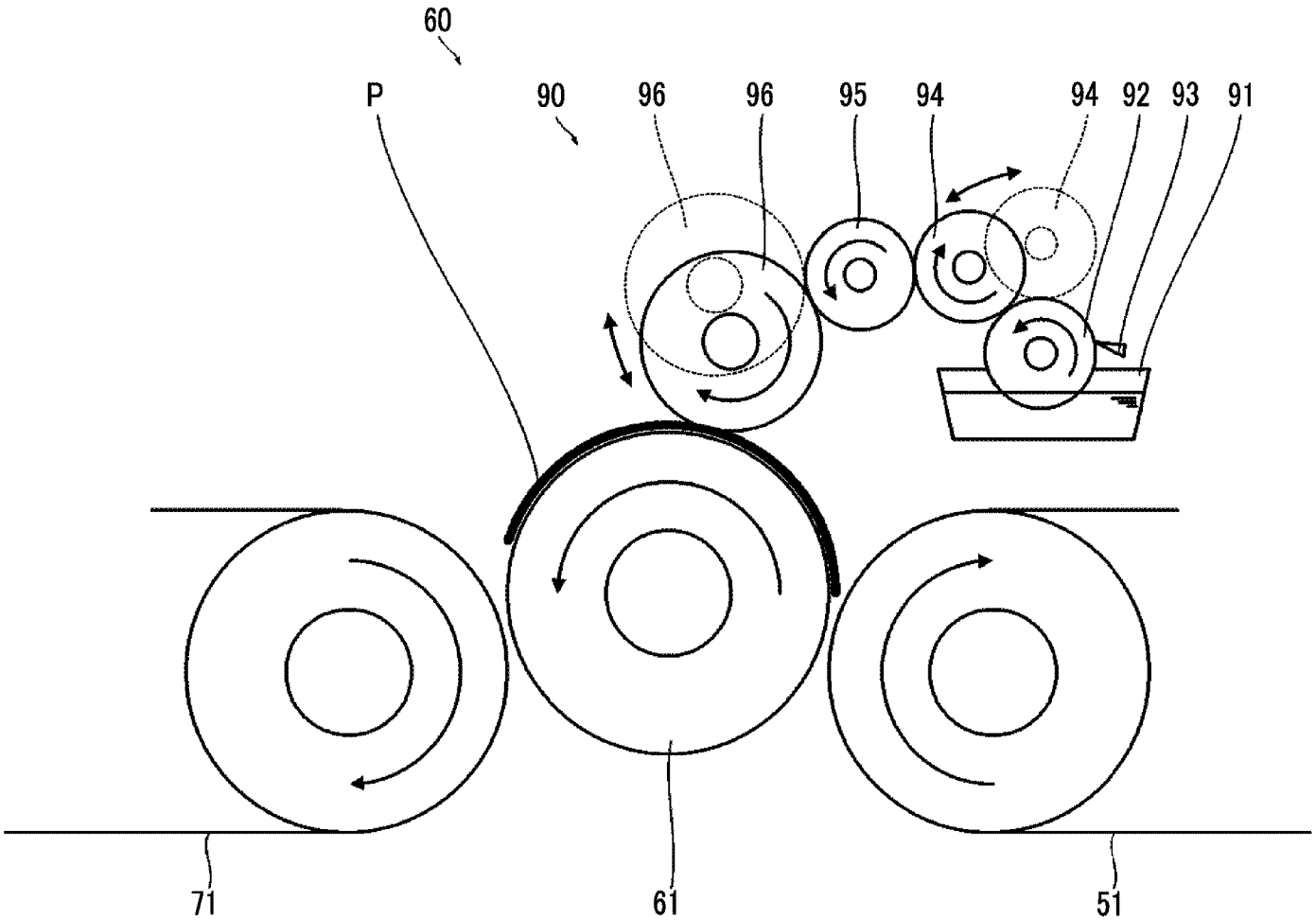
FIG. 2 is a diagram showing the schematic structure of a varnish coater.

FIG. 2 is a diagram showing the schematic structure of the varnish coater. The varnish coater 90 mainly includes a varnish tank 91, a draw-up roller 92 that draws up varnish, a metering blade 93, a first intermediate transfer roller 94, a second intermediate transfer roller 95, and a varnish applying roller 96.

The varnish tank 91 stores varnish. A varnish supply device (not shown) is connected to the varnish tank 91. Varnish is circulated and supplied to the varnish tank 91 from the varnish supply device. In the ink jet printing apparatus 1 of this embodiment, UV varnish is supplied to the varnish tank for the application of UV varnish.

The draw-up roller 92 draws up varnish from the varnish tank 91. A part of the draw-up roller 92 is immersed in the varnish stored in the varnish tank 91. The draw-up roller 92 rotates to allow the varnish to adhere to the peripheral surface thereof and to draw up the varnish from the varnish tank 91.

The metering blade 93 adjusts the thickness of the varnish, which adheres to the peripheral surface of the draw-up roller 92, by scraping unnecessary varnish off from the peripheral surface of the draw-up roller 92. The thickness of the varnish, which is to be applied to the sheet P, is adjusted by the metering blade 93.

The first intermediate transfer roller 94 and the second intermediate transfer roller 95 transfer the varnish, which is drawn up by the draw-up roller 92, to the varnish applying roller 96. The first intennediate transfer roller 94 is in contact with the draw-up roller 92 and the second intermediate transfer roller 95, and the second intennediate transfer roller 95 is in contact with the first intermediate transfer roller 94 and the varnish applying roller 96. The varnish, which is drawn up by the draw-up roller 92, is transferred to the first intermediate transfer roller 94 and is transferred to the peripheral surface of the varnish applying roller 96 from the first intermediate transfer roller 94 through the second intermediate transfer roller 95.

The first intermediate transfer roller 94 is provided to be oscillatable about the axis of rotation of the draw-up roller 92. The first intermediate transfer roller 94 is driven by an actuator (not shown) so as to be moved between a contact position that is shown in FIG. 2 by a solid line and a retreated position that is shown in FIG. 2 by a broken line. The first intermediate transfer roller 94 is in contact with the peripheral surface of the second intermediate transfer roller 95 in a case in which the first intermediate transfer roller 94 is moved to the contact position, and is to be spaced from the peripheral surface of the second intermediate transfer roller 95 in a case in which the first intermediate transfer roller 94 is moved to the retreated position. It is possible to turn on/off the supply of varnish to the varnish applying roller 96 by controlling the movement of the first intermediate transfer roller 94. That is, it is possible to control the supply of varnish and the stop of the supply of varnish.

The varnish applying roller 96 applies varnish to the surface of the image of the sheet P that is transported by the varnish coating drum 61. The varnish applying roller 96 is provided to be oscillatable about the axis of rotation of the second intermediate transfer roller 95. The varnish applying roller 96 is driven by an actuator (not shown) so as to be moved between an application position that is shown in FIG. 2 by a solid line and a spaced position that is shown in FIG. 2 by a broken line. The varnish applying roller 96 is in pressure contact with the peripheral surface of the varnish coating drum 61 in a case in which the varnish applying roller 96 is moved to the application position, and is separated from the peripheral surface of the varnish coating drum 61 in a case in which the varnish applying roller 96 is moved to the spaced position. It is possible to turn on/off the application of varnish to a sheet P by controlling the movement of the varnish applying roller 96. That is, it is possible to control whether or not varnish coating is present.

The varnish coating section 60 has the above-mentioned structure. The sheet P is delivered to the varnish coating drum 61 from the ink drying section-chain delivery 51. The varnish coating drum 61 transports the sheet P along a fixed transport path.

In a case in which varnish coating is to be performed, the varnish applying roller 96 is in pressure contact with the printing surface of the sheet P while the sheet P is transported by the varnish coating drum 61. Accordingly, varnish is applied to the printing surface and varnish coating is performed.

In a case in which varnish coating is not to be performed, the sheet P freely passes through the varnish coating section 60. That is, the sheet P is transported without being in pressure contact with the varnish applying roller 96. In this case, the varnish applying roller 96 is positioned at the spaced position and the first intermediate transfer roller 94 is positioned at the retreated position. Accordingly, the sheet P freely passes through the varnish coating section 60.

UV Irradiation Section

The UV irradiation section 70 irradiates the sheet P, to which UV varnish is applied by the varnish coating section 60, with UV to cure the UV varnish. As shown in FIG. 1, the UV irradiation section 70 includes: a UV irradiation section-chain delivery 71 that transports a sheet P; a UV irradiation section-sheet guide 72 that guides the sheet P transported by the UV irradiation section-chain delivery 71; and a UV irradiation device 73 that irradiates the surface of the image of the sheet P, which is transported by the UV irradiation section-chain delivery 71, with UV to cure the UV varnish.

The UV irradiation section-chain delivery 71 receives the sheet P from the varnish coating drum 61, and transports the received sheet P along a fixed transport path. The UV irradiation section-chain delivery 71 includes a pair of endless chains that travels along a fixed travel path, and grips front ends of sheets P by grippers laid on the pair of chains and transports the sheets P.

The UV irradiation section-sheet guide 72 guides the travel of the sheet P that is transported by the UV irradiation section-chain delivery 71. The UV irradiation section-sheet guide 72 includes a flat guide surface that is disposed along the transport path of the sheet P. The guide surface is provided with a plurality of suction holes. The sheet P, which is transported by the UV irradiation section-chain delivery 71, slides on the guide surface while air is sucked from the suction holes of the guide surface. Accordingly, the sheet P can be transported while tension is applied to the sheet P.

The UV irradiation device 73 irradiates the surface of the image of the sheet P, which is transported by the UV irradiation section-chain delivery 71, with UV. The UV irradiation device 73 includes a plurality of UV lamps. The UV lamps are arranged at regular intervals along the transport path of the sheet P.

The UV irradiation section 70 has the above-mentioned structure. The sheet P is delivered to the UV irradiation section-chain delivery 71 from the varnish coating drum 61. The UV irradiation section-chain delivery 71 transports the sheet P along a fixed transport path. While the sheet P is transported, the surface of the sheet P to which UV varnish is applied is irradiated with UV by the UV irradiation device 73. Accordingly, the applied UV varnish is cured.

In a case in which varnish coating is not to be performed, the sheet P freely passes through the UV irradiation section 70. That is, the UV irradiation device 73 is turned off and the sheet P is transported without being irradiated with UV.

Collection Section

The collection section 80 is a recovery section for the sheets P having been subjected to printing, and recovers sheets P that are sequentially discharged while stacking the sheets P. The collection section 80 includes a stacker 81. The stacker 81 stacks sheets P, which are sequentially discharged, on a tray while aligning the sheets P.

The sheet P is transported to the collection section 80 by the UV irradiation section-chain delivery 71. In a case in which the UV irradiation section-chain delivery 71 transports the sheet P to a predetermined sheet discharge position, the UV irradiation section-chain delivery 71 cancels the grip of the sheet P performed by the gripper and releases the sheet P. The collection section 80 receives the sheet P released from the UV irradiation section-chain delivery 71, and recovers the sheet P while stacking the sheet P on the tray.

Flow of the Entire Processing Performed by Ink Jet Printing Apparatus

In the ink jet printing apparatus 1 of this embodiment, sheets P are subjected to processing in the order of pre-coating, the drying of the pre-coating liquid, printing, the drying of ink, UV varnish coating, and the irradiation of UV.

The sheets P are sequentially fed from the sheet feeding section 10 at a fixed sheet feeding interval one by one. First, the sheets P, which are fed from the sheet feeding section 10, are subjected to pre-coating processing by the pre-coating section 20. That is, processing for applying pre-coating liquid to the printing surfaces of the sheets is performed.

Then, the sheets P, which have been subjected to the pre-coating processing, are subjected to drying processing by the pre-coating liquid drying section 30. That is, processing for drying the pre-coating liquid, which is applied to the printing surfaces, is performed.

Then, the sheets P of which the pre-coating liquid has been dried are subjected to printing processing by the printing section 40. That is, processing for printing images by jetting inks having the respective colors of cyan, magenta, yellow, and black to the printing surfaces is performed.

Then, the sheets P, which have been subjected to the printing processing, are subjected to drying processing by the ink drying section 50. That is, processing for drying the ink jetted to the printing surfaces is performed. In this case, drying intensity is set so that temperature T where the sheet P reaches is in the prescribed range ($T1 \leq T \leq T2$), and the drying processing is performed. This will be described below.

Then, the sheets P of which the ink has been dried are subjected to UV varnish coating by the varnish coating section 60. That is, processing for applying UV varnish to the surfaces of the images is performed.

Then, the sheets P, which have been subjected to the UV varnish coating, are subjected to UV irradiation processing by the UV irradiation section 70. That is, processing for irradiating the surfaces of the sheets, which have been subjected to varnish coating, with UV to cure UV varnish is performed.

The sheets P, which are irradiated with UV, are sequentially discharged to the collection section 80, and are recovered while being stacked in the form of a bundle.

Since the sheets P are heated and dried so that temperature T where the sheet P reaches is in the prescribed range ($T1 \leq T \leq T2$) in a case in which the sheets P having been subjected to printing are to be dried, the glossiness and adhesiveness of UV varnish to be applied in a subsequent step can be successfully ensured. Further, deformation, such as curl and cockle, of the sheet P and the occurrence of blocking can also be prevented.

Control System of Ink Jet Printing Apparatus

Figure 3:
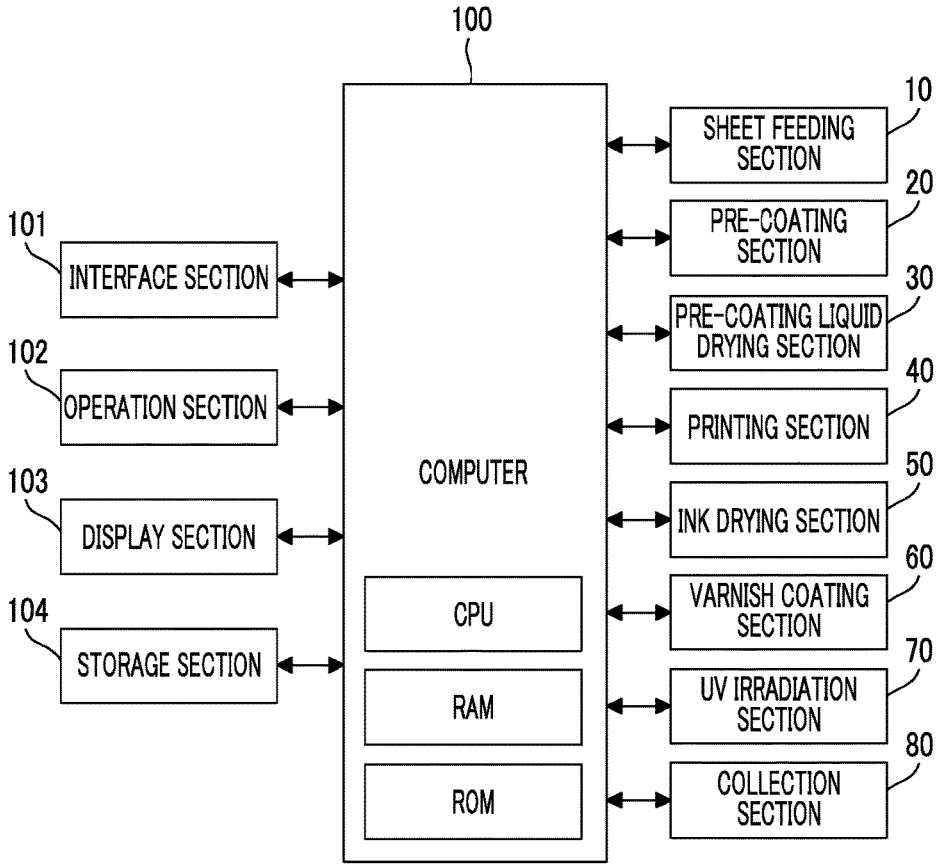
FIG. 3 is a block diagram showing the schematic structure of a control system of the ink jet printing apparatus.

FIG. 3 is a block diagram showing the schematic structure of a control system of the ink jet printing apparatus.

The entire operation of the ink jet printing apparatus 1 is controlled by a computer 100. The computer 100 includes a central processing unit (CPU), a random access memory (RAM), a read only memory (ROM), and the like; and an interface section 101, an operation section 102, a display section 103, a storage section 104, and the like are connected to the computer 100.

The interface section 101 is means for being connected to an external device. A connection method is not particularly limited, and various methods can be employed as the connection method. Image data to be printed is acquired from the external device and the like through the interface section 101.

The operation section 102 is means for operating the ink jet printing apparatus 1. The operation section 102 is formed of an input device, such as a touch panel, a mouse, or a keyboard.

The display section 103 is means for displaying various kinds of information. The display section 103 is formed of, for example, a display device, such as an LCD monitor.

The storage section 104 is means for storing various kinds of information. The storage section 104 is formed of, for example, a storage device, such as a hard disk drive. Programs executed by the computer 100, various data required for control, and the like are stored in the ROM or the storage section 104.

Control of Each Section

Figure 4:
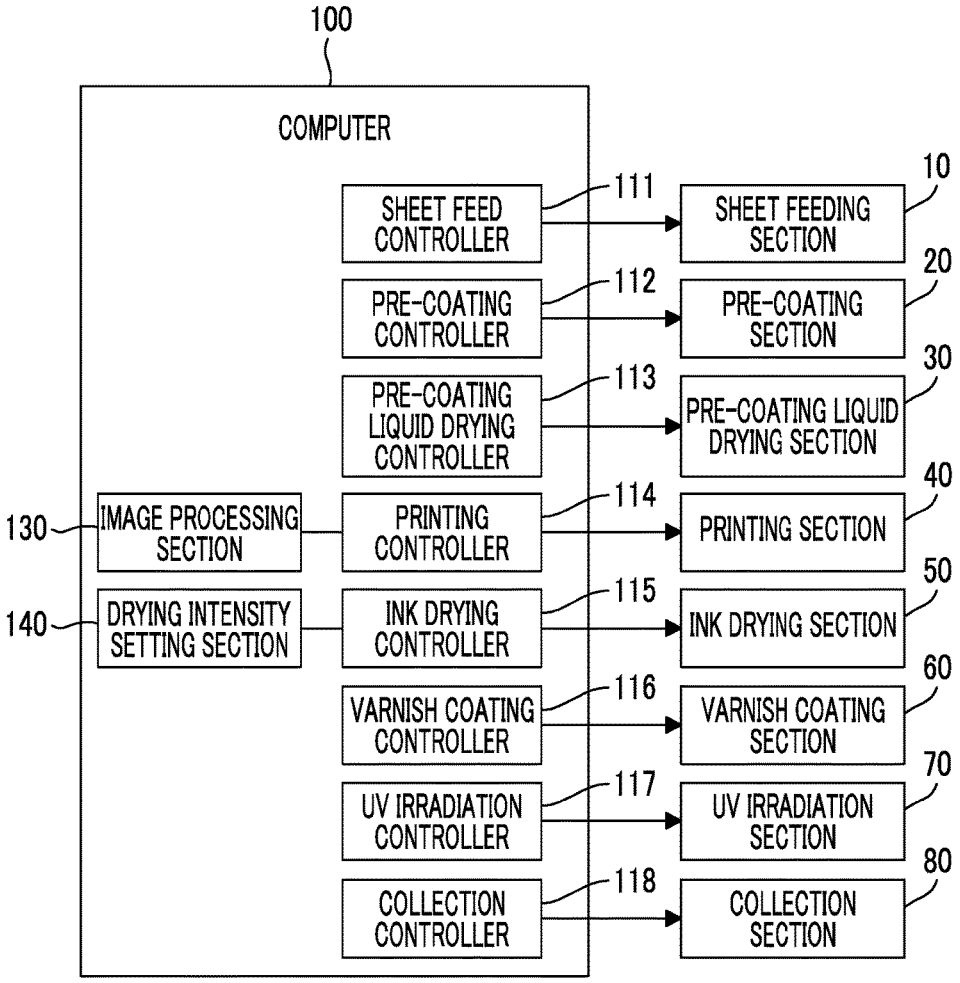
FIG. 4 is a block diagram of functions achieved by a computer.

FIG. 4 is a block diagram of functions achieved by the computer.

As shown in FIG. 4, the computer 100 functions as a sheet feed controller 111, a pre-coating controller 112, a pre-coating liquid drying controller 113, a printing controller 114, an ink drying controller 115, a varnish coating controller 116, a UV irradiation controller 117, and a collection controller 118 by executing predetermined programs.

The sheet feed controller 111 controls the feeding of sheets P by controlling the sheet feeding section 10. Specifically, the sheet feed controller 111 controls the operations of the respective parts of the sheet feeding section 10 so that sheets P are sequentially fed at a constant speed.

The pre-coating controller 112 controls the application of pre-coating liquid to a sheet P by controlling the pre-coating section 20. Specifically, the pre-coating controller 112 controls the operations of the respective parts of the pre-coating section 20 so that the pre-coating liquid is applied to a sheet P with a predetermined thickness.

The pre-coating liquid drying controller 113 controls the drying of the pre-coating liquid, which is applied to the sheet P, by controlling the pre-coating liquid drying section 30. Specifically, the pre-coating liquid drying controller 113 controls the operations of the respective parts of the pre-coating liquid drying section 30 so that the applied pre-coating liquid is dried at a predetermined drying rate.

The printing controller 114 controls the printing of an image on the sheet P by controlling the printing section 40. Specifically, the printing controller 114 controls the operations of the respective parts of the printing section 40 so that a predetermined image is printed on the sheet P.

The ink drying controller 115 controls the drying of ink by controlling the ink drying section 50. Specifically, the ink drying controller 115 controls the operations of the respective parts of the ink drying section 50 so that applied ink is dried at a predetermined drying rate. In this case, drying intensity is set so that temperature T where the sheet P reaches is in the prescribed range ($T1 \leq T \leq T2$), and the drying processing is performed. This will be described below.

The varnish coating controller 116 controls the application of varnish to the sheet P by controlling the varnish coating section 60. Specifically, the varnish coating controller 116 controls the operations of the respective parts of the varnish coating section 60 so that varnish is applied with a constant thickness. In a case in which varnish coating is not to be performed, the varnish coating controller 116 controls the operations of the respective parts of the varnish coating section 60 so that varnish is not applied. Varnish, which is to be applied in a case in which varnish coating is to be performed, is UV varnish.

The UV irradiation controller 117 controls the irradiation of the sheet P with UV by controlling the UV irradiation section 70. Specifically, in a case in which UV varnish coating is to be performed, the UV irradiation controller 117 irradiates a sheet P with UV by operating the UV irradiation section 70.

The collection controller 118 controls the collection of sheets P by controlling the collection section 80. Specifically, the collection controller 118 controls the operations of the respective parts of the collection section 80 so that sheets P sequentially to be discharged are recovered while being stacked in the form of a bundle.

Image Processing Section

As shown in FIG. 4, the computer 100 also functions as an image processing section 130 by executing a predetermined program.

The image processing section 130 converts image data, which is acquired from an external device and the like to print an image, into data (print data) having a format that can be processed by the ink jet printing apparatus 1.

Figure 5:
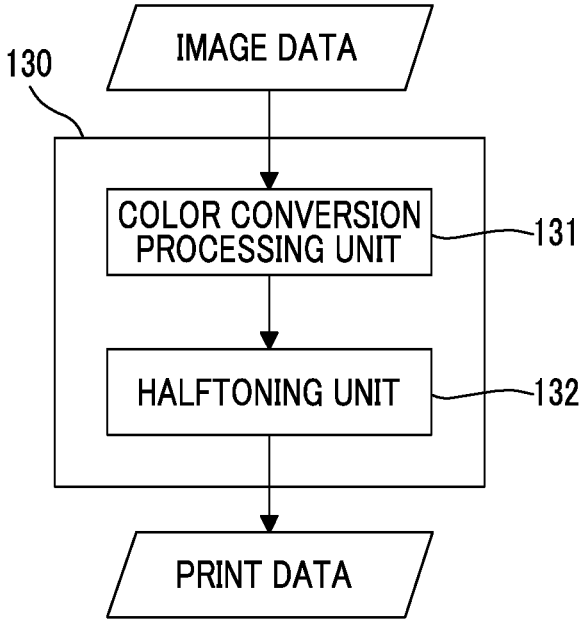
FIG. 5 is a block diagram of functions achieved by an image processing section.

FIG. 5 is a block diagram of functions achieved by the image processing section.

The image processing section 130 includes a color conversion processing unit 131 and a halftoning unit 132.

Color Conversion Processing Unit

The color conversion processing unit 131 performs processing for converting image data, which is acquired from an external device and the like to print an image, into ink-amount data corresponding to the respective colors that are used in the printing section 40.

The image data, which is acquired from an external device and the like, is, for example, image data that is expressed as an RGB format, such as sRGB. sRGB is the reference of a RGB color space that is established by International Electrotechnical Commission (IEC). RGB is a type of a method of expressing colors, and is a type of additive mixing for reproducing a wide variety of colors by mixing three primary colors of red (R), green (G), and blue (B). RGB means the initials of the three primary colors.

The printing section 40 prints an image with inks having four colors of cyan (C), magenta (M), yellow (Y), and black (K). Accordingly, the color conversion processing unit 131 converts the image data into ink-amount data corresponding to the respective colors of cyan, magenta, yellow, and black.

Processing for converting image data into ink-amount data corresponding to the respective colors, that is, color conversion processing is performed with reference to, for example, a look-up table. In this method, a look-up table in which combinations of the amounts of inks to be output corresponding to input RGB values are written in advance is prepared and the amounts of inks to be output are obtained with reference to the look-up table.

Halftoning Unit

The halftoning unit 132 performs processing for converting the ink-amount data corresponding to the respective colors, which are generated by the color conversion processing unit 131, into dot arrangement data that is expressed by ON/OFF of dots. The halftoning unit 132 performs the halftoning of the ink-amount data corresponding to the respective colors, which are generated by the color conversion processing unit 131, to convert the ink-amount data into dot arrangement data corresponding to the respective colors.

The dot arrangement data, which is generated by the halftoning unit 132, is referred to as the print data. The printing controller 114 drives the respective ink jet heads 44C, 44M, 44Y, and 44K on the basis of the generated print data to print an image, which is represented by the image data, on a sheet P.

Drying Intensity Setting Section

As shown in FIG. 4, the computer 100 also functions as a drying intensity setting section 140 by executing a predetermined program.

The drying intensity setting section 140 sets the drying intensity of the ink drying section 50. In this case, the drying intensity setting section 140 sets the drying intensity so that temperature where the sheet P reaches through heating is in the prescribed range. The temperature where the sheet P reaches is the maximum temperature where the sheet P reaches through the heating of the sheet P. Accordingly, for example, in a case in which the temperature of the sheet P rises up to 100° C. through the heating of the sheet P, the temperature where the sheet reaches is 100° C. In a case in which the lower limit of temperature at which the deterioration of the gloss of UV varnish can be prevented and blocking can be prevented is denoted by T1 and the upper limit of temperature at which the deterioration of the adhesiveness of UV varnish can be prevented and the deformation of the sheet P can be prevented is denoted by T2, the prescribed range is set in the range of T1 to T2 (T1≤T≤T2).

"The deterioration of the gloss of UV varnish can be prevented" means that the deterioration of the gloss can be prevented in an allowable range. Likewise, "blocking can be prevented" means that blocking can be prevented in an allowable range. Further, "the deterioration of the adhesiveness of UV varnish can be prevented" means that the deterioration of the adhesiveness can be prevented in an allowable range. Furthermore, "the deformation of a sheet can be prevented" means that the deformation of a sheet can be prevented in an allowable range.

The temperature T1 is changed depending on the type of UV varnish to be used, the type of the sheet, the thickness of the sheet, whether printing is surface printing or back printing, or the like. Therefore, the temperature T1 is not determined as a specific numerical value and needs to be adjusted depending on combinations of the respective conditions.

It is preferable that the temperature T2 is set to be lower than 100° C. since the boiling point of moisture is 100° C. However, since it may be difficult to deform a certain type of a sheet, the temperature T2 can also be set to 100° C. or more.

A preferred range of the temperature where the sheet P reaches (a prescribed range of the temperature where the sheet reaches) will be described in detail below.

Figure 6:
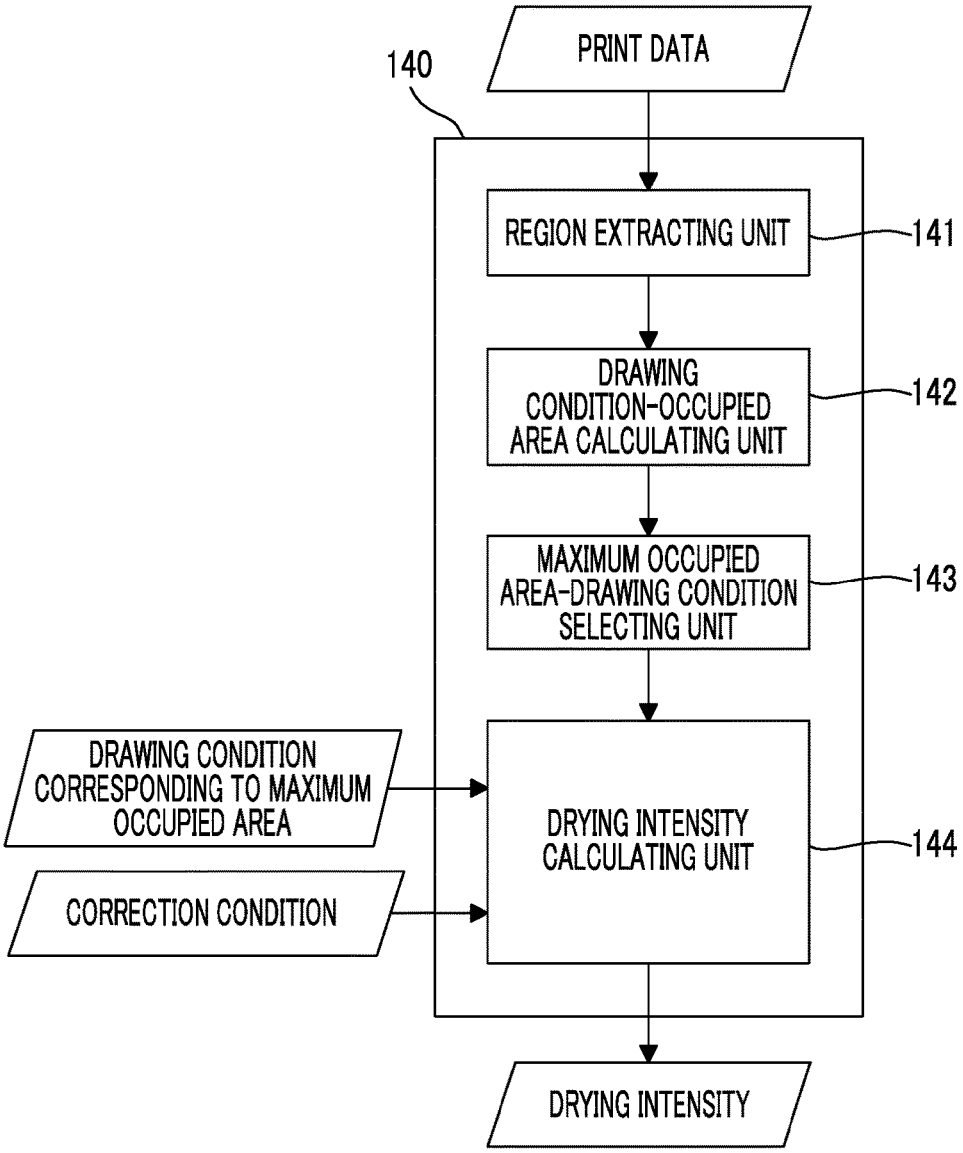
FIG. 6 is a block diagram of functions achieved by a drying intensity setting section.

FIG. 6 is a block diagram of functions achieved by the drying intensity setting section.

The drying intensity setting section 140 includes: a region extracting unit 141 that analyzes an image to be printed on a sheet and extracts regions corresponding to the same drawing conditions; a drawing condition-occupied area calculating unit 142 that calculates an occupied area corresponding to each drawing condition; a maximum occupied area-drawing condition selecting unit 143 that selects a drawing condition corresponding to the maximum occupied area; and a drying intensity calculating unit 144 that calculates drying intensity, which is to be set in the ink drying section 50, on the basis of the drawing condition selected by the maximum occupied area-drawing condition selecting unit 143.

Region Extracting Unit

The region extracting unit 141 analyzes an image (here, print data) to be printed on a sheet and extracts regions corresponding to the same drawing conditions. Here, the region extracting unit 141 analyzes the print data and extracts regions corresponding to the same drawing conditions. The drawing condition is prescribed by a color and the amount of ink. That is, the regions corresponding to the same drawing conditions are regions having the same colors and the same amounts of ink. Accordingly, the region extracting unit 141 extracts regions having the same colors and the same amounts of ink.

Here, "having the same colors" means that the respective density gradation levels of C, M, Y, and K are the same. The density gradation level of each color is idiomatically expressed by dot percent. Dot percent is a ratio of the area of dots occupied per unit area in dot gradation that is expressed by percent (%: percentage), and represents the degree of the gradation of a printed article. The dot percent of a so-called solid printed portion is 100%, the dot percent of a blank portion is 0%, and the dot percent of an intermediate portion is 50%. Dot percent is also referred to as dot %. Accordingly, the fact that the color of a region is the same as that of another region means that the dot % of each of C, M, Y, and K of a region is the same as that of another region.

In a case in which a density gradation level is expressed by dot %, the density gradation levels of C, M, Y, and K are expressed as C10, M20, Y30, and K40, respectively. In this case, C10, M20, Y30, and K40 mean that the density gradation level of cyan (C) is 10%, the density gradation level of magenta (M) is 20%, the density gradation level of yellow (Y) is 30%, and the density gradation level of black (K) is 40%. Then, regions having the same colors mean regions having the same numerical values.

Strictly speaking, a case in which the dot % of each of C, M, Y, and K of a region is completely the same as that of another region is a case in which the color of a region is the same as that of another region, but a range in which regions are regarded to have the same color may have a certain width. For example, in a case in which the dot % of each color is classified into ranges at an interval of 3% and regions are classified into the same range, the regions may be regarded to have the same dot % and it may be determined whether or not the regions have the same color. In this case, for example, "C10, M20, Y30, and K40" and "C11, M22, Y32, and K41" are regarded to have the same colors. An arithmetic processing load can be reduced in a case in which a range in which regions are regarded to have the same color has a certain width in this way. It is more preferable that the numerical value of the width of the regions regarded to have the same color can be set and changed.

Further, the fact that regions have the same amount of ink means that regions have the same average amount of ink per unit area.

One unit of regions to be extracted is prescribed as, for example, a case in which regions corresponding to the same drawing condition are continued in the range of X inch×Y inch (1 inch≅25.4 mm). X and Y may be fixed values, and may be numerical values that can be arbitrarily set by a user. Only an image region, which is visually recognized as a so-called solid in a wide range, serves as an object as X and Y are increased. Further, a region in which a continuous range is smaller than a certain area not reaching X inch×Y inch is excluded from an object to be extracted. Accordingly, since a minute region, which less affects the setting of drying intensity, can be excluded, a load of subsequent processing can be reduced.

Figures 7, 8:
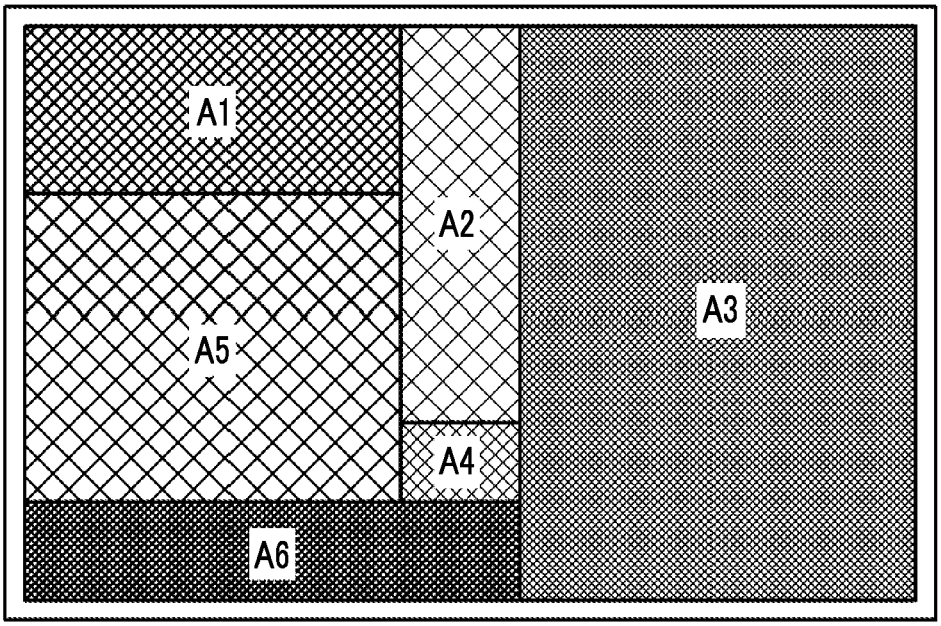
FIG. 7 is a diagram showing an example of an image to be printed.
FIG. 8 is a table showing calculation results of occupied areas, which correspond to the respective drawing conditions, of the image shown in FIG. 7.

FIG. 7 is a diagram showing an example of an image to be printed.

In the case of an example shown in FIG. 7, six regions, that is, regions A1 to A6 are extracted as regions corresponding to the same drawing conditions.

Drawing Condition-Occupied Area Calculating Unit

The drawing condition-occupied area calculating unit 142 calculates the occupied areas of the regions that are extracted by the region extracting unit 141 and correspond to the respective drawing conditions. The occupied area corresponding to each drawing condition is calculated. Accordingly, in a case in which a plurality of regions corresponding to the same drawing condition are extracted, the regions are combined as one region and the occupied area of the combined region is calculated. That is, in a case in which discontinuous (so-called isolated) two or more extracted regions are present, the extracted regions are regarded as one image region (an image region corresponding to one condition) and the occupied area thereof is calculated.

FIG. 8 is a table showing calculation results of occupied areas, which correspond to the respective drawing conditions, of the image shown in FIG. 7.

The occupied areas of the regions A1, A2, A3, A4, A5, and A6, which are extracted as the regions corresponding to the same drawing conditions, are denoted by S1, S2, S3, S4, S5, and S6, respectively.

In FIG. 8, an area occupancy is a ratio of each region to the printable region of a sheet P. The printable region is a region in which an image can be printed by the printing section 40. Generally, since margins are set on the front, rear, left, and right of the sheet P, the region of the sheet P excluding the margins is the printable region. In a case in which the area of the printable region is denoted by S0, an area occupancy Rn is calculated from "Rn=Sn/S0" (n is the number of the region). For example, the occupied area R1 of the region A1 is calculated from "R1=S1/S0". The region having the maximum occupied area has the maximum area occupancy.

Since there is also a region excluded from an object to be extracted, the sum of the area occupancies of the regions cannot be necessarily 100%.

Maximum Occupied Area-Drawing Condition Selecting Unit

The maximum occupied area-drawing condition selecting unit 143 selects a drawing condition, which corresponds to the maximum occupied area, on the basis of the occupied areas that are calculated by the drawing condition-occupied area calculating unit 142 and correspond to the respective drawing conditions.

In the case of the image of FIG. 7, the drawing condition, which corresponds to the maximum occupied area, is the drawing condition of the region A3 as shown in FIG. 8. Accordingly, in the case of the example shown in FIG. 7, the maximum occupied area-drawing condition selecting unit 143 selects the drawing condition of the region A3 as the drawing condition that corresponds to the maximum occupied area.

Since the region having the maximum occupied area also has the maximum area occupancy, the region having the maximum area occupancy can be extracted and the drawing condition corresponding to the maximum occupied area can also be selected.

Drying Intensity Calculating Unit

The drying intensity calculating unit 144 calculates drying intensity, which is to be set in the ink drying section 50, on the basis of the drawing condition selected by the maximum occupied area-drawing condition selecting unit 143. Specifically, the drying intensity calculating unit 144 obtains a correction condition corresponding to the drawing condition, which is selected by the maximum occupied area-drawing condition selecting unit 143, with reference to correction conditions prescribed for the respective drawing conditions; and calculates drying intensity by correcting reference drying intensity with the obtained correction condition. That is, the drying intensity calculating unit 144 calculates drying intensity, which is to be set in the ink drying section 50, by correcting drying intensity serving as a reference (reference drying intensity) with the correction condition that corresponds to the drawing condition corresponding to the maximum occupied area.

Reference Drying Intensity

The reference drying intensity is set as intensity that allows temperature where the sheet P reaches to be in the prescribed range (T1≤T≤T2) in a case in which a predetermined image is printed under a predetermined printing condition. Reference drying intensity is also changed in a case in which a printing condition is changed. Accordingly, it is preferable that reference drying intensity is set according to a printing condition.

The setting of reference drying intensity is performed by the computer 100. The computer 100 functions as a reference drying intensity setting section 150 by executing a predetermined program.

Figures 9, 10:
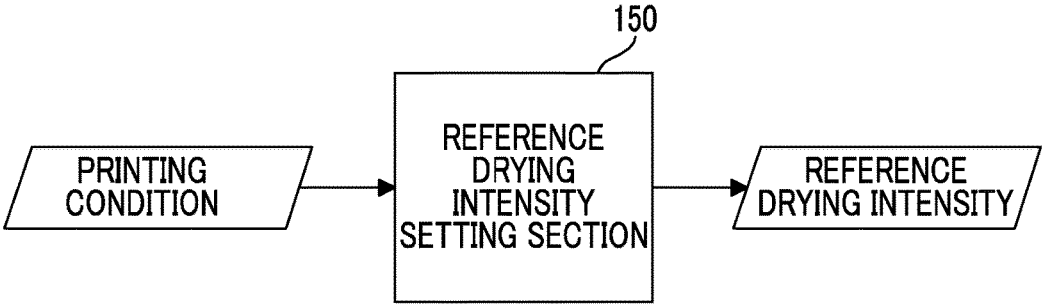
FIG. 9 is a block diagram of functions provided by a reference drying intensity setting section.
FIG. 10 is a table showing an example of the setting of reference drying intensity.

FIG. 9 is a block diagram of functions provided by the reference drying intensity setting section.

The reference drying intensity setting section 150 acquires information about the printing condition, and sets reference drying intensity on the basis of the acquired information about the printing condition.

The printing condition includes, for example, the type of UV varnish, the type of a sheet, the thickness (weight) of a sheet, the distinction of a printing surface, and the like. The distinction of a printing surface is the distinction of whether printing is surface printing or back printing. The back printing is printing that is performed on the back (the surface not subjected to printing) of a printed sheet. Further, the surface printing is printing that is performed on a sheet not subjected to printing. For example, the reference drying intensity setting section 150 acquires information, which is input from the operation section 102 by a user, and the like and acquires information about the printing condition.

The reference drying intensity setting section 150 prepares a table in which printing conditions are associated with reference drying intensity in advance, and sets reference drying intensity with reference to the table. In addition, for example, the reference drying intensity setting section 150 prescribes drying intensity, which is obtained in a case in which a predetermined image is printed under a predetermined printing condition, as standard drying intensity, and obtains reference drying intensity by correcting the standard drying intensity with the amount of correction that is prescribed for each printing condition.

FIG. 10 is a table showing an example of the setting of the reference drying intensity.

In the example shown in FIG. 10, information about the type of UV varnish, the type of a sheet, the thickness of a sheet, and the distinction of a printing surface is acquired as a printing condition and reference drying intensity is set on the basis of these kinds of information. In this example, the type of UV varnish is "varnish A", the type of a sheet is "sheet A", the thickness of a sheet is 0.38 mm, the distinction of a printing surface is surface printing, and reference drying intensity is set to 8.

Further, in the example shown in FIG. 10, a color is set to any one of cyan (C), magenta (M), and yellow (Y) and the amount of ink is set to 3.0 pL as the drawing condition for an image. The drawing condition for an image, which is required to obtain reference drying intensity, is not limited thereto.

Correction Condition

The drying intensity calculating unit 144 calculates drying intensity, which is to be set in the ink drying section 50, by correcting reference drying intensity with the correction condition that corresponds to the drawing condition corresponding to the maximum occupied area. A correction condition is prescribed as the amount of correction of the reference drying intensity.

Correction conditions are prescribed in a table and are prescribed for the respective drawing conditions. Since a drawing condition is prescribed by a color and the amount of ink as described above, a correction condition is prescribed for each of colors and each of the amounts of ink.

FIG. 11 is a diagram showing an example of a table in which a correction condition corresponding to each color is prescribed. FIG. 11 is a part of a table in which a correction condition corresponding to each color is prescribed, and shows an example of typical colors.

In FIG. 11, K means black, C means cyan, M means magenta, Y means yellow, R means red, G means green, and B means blue. 4C means a mixed color using four colors of cyan, magenta, yellow, and black. 3C means a mixed color using cyan, magenta, and black.

Since blackish colors, such as black (K) and 4C, have high absorbance for the heat of a heater and allow temperature at the time of drying to easily rise, blackish colors, such as black (K) and 4C, are subjected to correction in which drying intensity is reduced.

FIG. 12 is a diagram showing an example of a table in which a correction condition corresponding to each of the amounts of ink is prescribed.

As shown in FIG. 12, the amount of correction is set so as to increase drying intensity as the amount of ink is increased with respect to the amount of ink serving as a reference (3.0 pL in this example), and the amount of correction is set so as to reduce drying intensity as the amount of ink is reduced with respect to the amount of ink serving as a reference.

The amount of ink is the average amount of ink per unit area, and is defined as in the following expression.

$$\text{The amount of ink}=((A\times N1)+(B\times N2))/(N0+N1+N2)$$

Here, N0 denotes the number of dots that are not jetted, N1 denotes the number of jetted small dots, and N2 denotes the number of jetted large dots. N1 and N2 are determined with respect to target image density by halftone design.

Further, A denotes the amount of small liquid droplets (pL), and B denotes the amount of large liquid droplets (pL). In the case of the ink jet printing apparatus 1 of this embodiment, the amount of large liquid droplets is 6.7 pL and the amount of small liquid droplets is 2.2 pL.

The calculation of the amount of ink varies depending on the resolution of the ink jet printing apparatus. In the ink jet printing apparatus of this embodiment, the calculation of the amount of ink is performed at a resolution of, for example, 1200 dpi×1200 dpi (dpi: dot per inch/the number of dots per inch).

Further, the calculation of the amount of ink varies depending on the size of a liquid droplet that can be jetted. The above-mentioned example is an example of a case in which large liquid droplets and small liquid droplets can be jetted. Even though liquid droplets having three sizes, such as large liquid droplets, medium liquid droplets, and small liquid droplets, can be jetted, the amount of ink is calculated without consideration of the jetting of large liquid droplets in a case in which large liquid droplets are not used in general printing. A case in which large liquid droplets, medium liquid droplets, and small liquid droplets can be jetted and large liquid droplets are not used in general printing is, for example, a case in which large ink droplets are used for the correction of non-jet, the correction of density unevenness, and the like.

Arithmetic Processing

The drying intensity calculating unit 144 obtains a correction condition corresponding to the drawing condition, which is selected by the maximum occupied area-drawing condition selecting unit 143, with reference to a table in which correction conditions are prescribed; and calculates drying intensity by correcting reference drying intensity with the obtained correction condition.

In the case of the image shown in FIG. 7, drying intensity will be calculated as described below.

In the case of the image shown in FIG. 7, the drawing condition, which is selected as the drawing condition corresponding to the maximum occupied area by the maximum occupied area-drawing condition selecting unit 143, is the drawing condition of the region A3.

The drying intensity calculating unit 144 acquires the information about the drawing condition of the region A3, and obtains a correction condition corresponding to the drawing condition of the region A3. The drying intensity calculating unit 144 acquires the correction condition with reference to the table. According to FIG. 8, in the drawing condition of the region A3, a color is magenta (M) and the amount of ink is 2.0 pL. Further, according to FIGS. 11 and 12, in the correction condition corresponding to the drawing condition of the region A3, the amount of correction is 0 in regard to a color and the amount of correction is −1 in regard to the amount of ink. Accordingly, a correction condition (the amount of correction) in this case is −1 (=(0)+(−1)) that is the sum of the amount of correction in regard to a color and the amount of correction in regard to the amount of ink.

Reference drying intensity is calculated with the obtained correction condition. In a case in which the reference drying intensity is 8, drying intensity to be obtained is 7 ((reference drying intensity (8))+(the amount of correction (−1))=(drying intensity (7)).

Drying Intensity Setting Method

Figure 13:
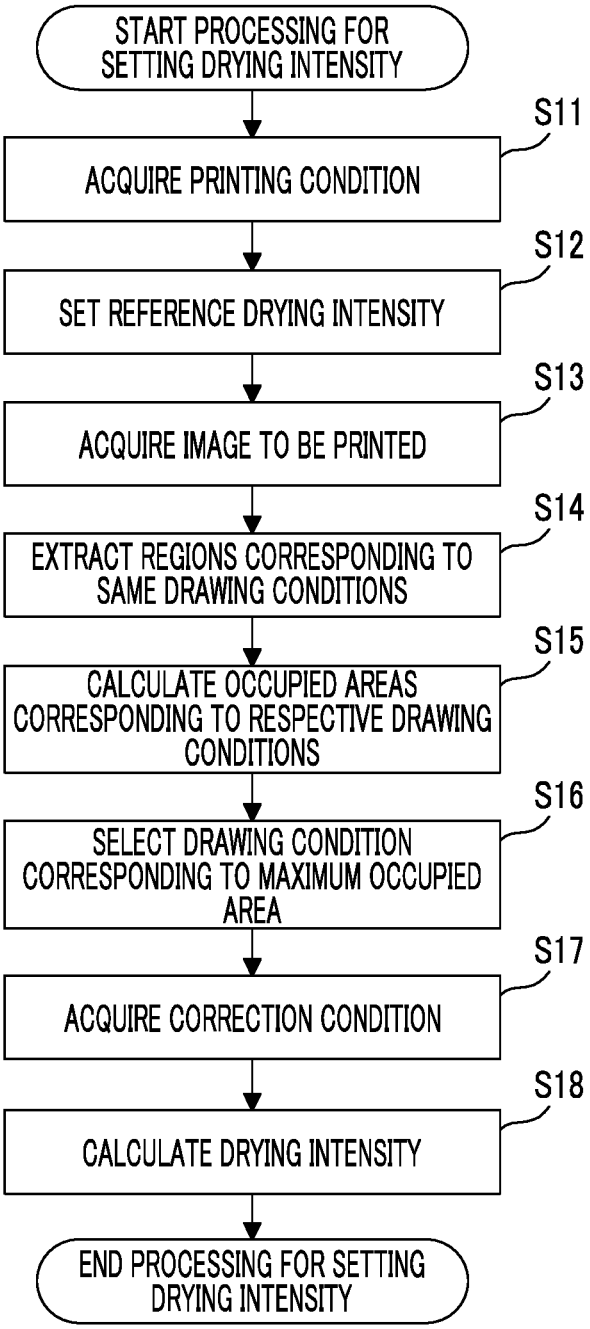
FIG. 13 is a flow chart showing a procedure for setting the drying intensity of an ink drying section.

FIG. 13 is a flow chart showing a procedure for setting the drying intensity of the ink drying section.

First, information about a printing condition is acquired to set reference drying intensity (Step S11). Here, information about the type of UV varnish, the type of a sheet, the thickness of a sheet, and the distinction of a printing surface is acquired. The information is input through the operation section 102 by a user.

Next, reference drying intensity is set on the basis of the acquired information about the printing condition (Step S12). The reference drying intensity is set with reference to a table on the basis of the information that is acquired as the printing condition.

Then, an image to be printed is acquired (Step S13). Here, print data is acquired. The print data is acquired from the image processing section 130.

Next, the acquired print data is analyzed and regions corresponding to the same drawing conditions are extracted (Step S14). Here, regions having the same colors and the same amounts of ink are extracted.

Then, the occupied areas corresponding to the respective drawing conditions are calculated (Step S15). That is, regions corresponding to the same drawing condition are combined as one region, and the occupied areas corresponding to the respective drawing conditions are calculated.

Next, a drawing condition corresponding to the maximum occupied area is selected on the basis of the calculated occupied areas corresponding to the respective drawing conditions (Step S16).

Then, a correction condition is acquired on the basis of a drawing condition that is selected as the drawing condition corresponding to the maximum occupied area (Step S17). The correction condition is acquired with reference to a table. That is, a correction condition corresponding to the selected drawing condition is read and acquired from a table.

Next, drying intensity, which is to be set in the ink drying section 50, is calculated through the correction of the setting of reference drying intensity performed with the acquired correction condition (Step S18).

The drying intensity, which is to be set in the ink drying section 50, is obtained from the above-mentioned series of steps, and can be set to intensity that allows temperature where a sheet P reaches to be in a prescribed range. At the time of printing, the ink drying controller 115 operates the heating device 53 at the set drying intensity to dry the sheet P having been subjected to printing. Accordingly, the sheet P can be dried while temperature where the sheet P reaches is in the prescribed range ($T1 \leq T \leq T2$). Therefore, the gloss of UV varnish to be applied in a subsequent step can be successfully ensured and the adhesiveness of UV varnish can also be successfully ensured. Further, the deformation of the sheet P can also be prevented and the occurrence of blocking can also be prevented.

Modification Example

There is a case in which a plurality of drawing conditions are selected for a certain image for the selection of a drawing condition corresponding to the maximum occupied area. In this case, it is preferable that the plurality of drawing conditions are handled as described below. That is, drying intensity is calculated for each of the selected plurality of drawing conditions. In a case in which all the calculated drying intensities are the same, the calculated drying intensity is set as the drying intensity of the ink drying section 50. On the other hand, in a case in which the calculated drying intensities are different from each other, drying intensity calculated at the highest intensity is set as the drying intensity of the ink drying section 50. The reason for this is that it is thought that there are many cases in which a risk is low in a case in which the strength of a film is ensured.

Second Embodiment

In the ink jet printing apparatus of the first embodiment, the drying intensity of the ink drying section 50 is set so as to correspond to a region, which occupies the highest percentage, in a case in which an image is divided into regions corresponding to the respective drawing conditions.

In the ink jet printing apparatus of this embodiment, the drying intensity of the ink drying section 50 is set so as to correspond to a region having the maximum occupied area among the regions that are to be set to the same drying intensity.

Since the ink jet printing apparatus of this embodiment is different from the ink jet printing apparatus of the first embodiment in terms of only a method of setting drying intensity, only configuration relating to the setting of drying intensity will be described here.

Drying Intensity Setting Section

The setting of the drying intensity of the ink drying section 50 is performed by a drying intensity setting section 140. The functions of the drying intensity setting section 140 are achieved through the execution of a predetermined program that is performed by the computer.

Figure 14:
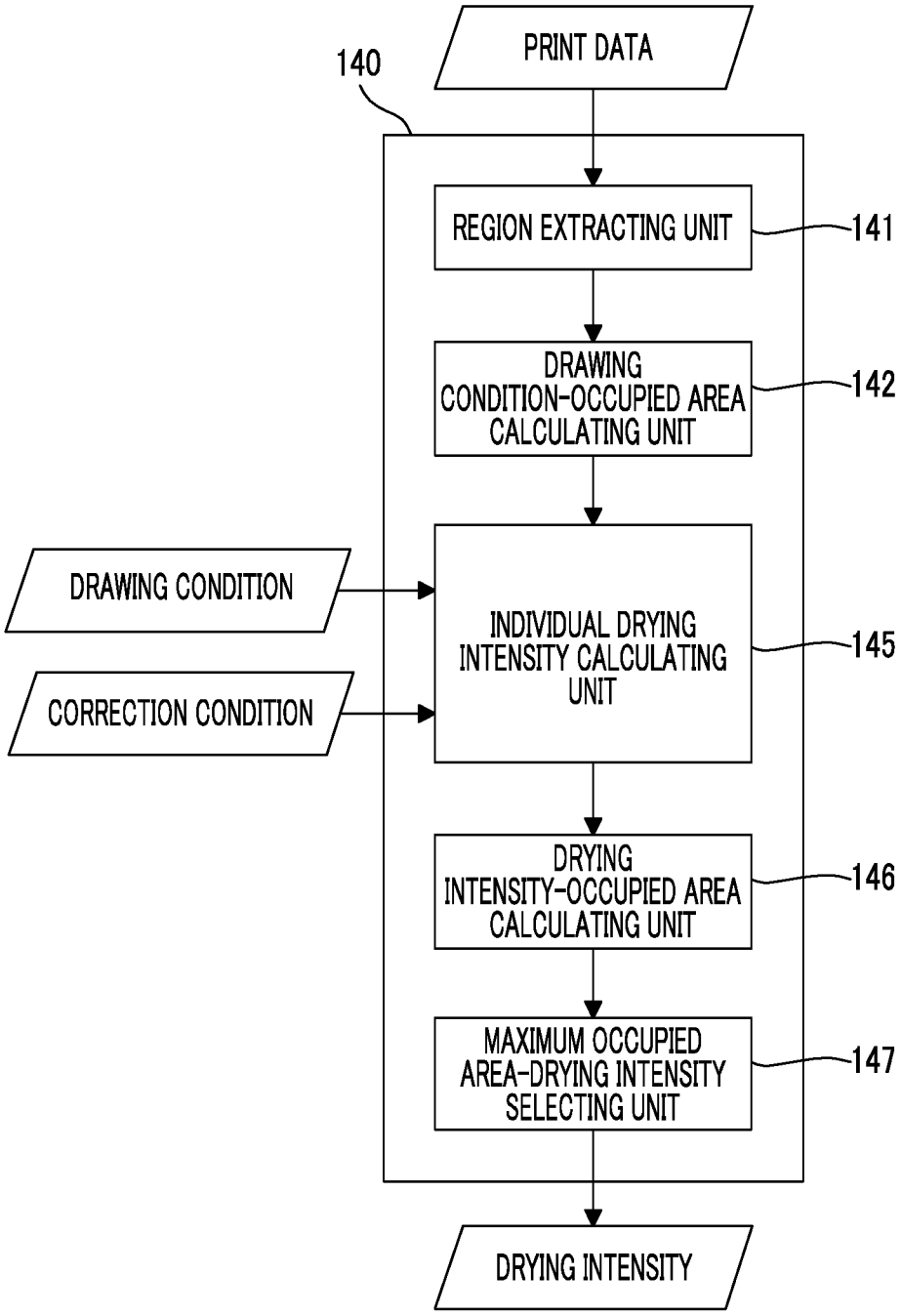
FIG. 14 is a block diagram of functions achieved by the drying intensity setting section.

FIG. 14 is a block diagram of functions achieved by the drying intensity setting section.

The drying intensity setting section 140 includes: a region extracting unit 141 that analyzes an image to be printed on a sheet P and extracts regions corresponding to the same drawing conditions; a drawing condition-occupied area calculating unit 142 that calculates occupied areas corresponding to the respective drawing conditions; an individual drying intensity calculating unit 145 that calculates drying intensity for each drawing condition by correcting reference drying intensity with a correction condition prescribed for each drawing condition; a drying intensity-occupied area calculating unit 146 that groups the drawing conditions corresponding to the same drying intensities and calculates the occupied areas for the respective drying intensities; and a maximum occupied area-drying intensity selecting unit 147 that selects drying intensity corresponding to the maximum occupied area. The drying intensity, which is selected by the maximum occupied area-drying intensity selecting unit 147, is set as the drying intensity of the ink drying section 50.

Region Extracting Unit

The region extracting unit 141 analyzes an image to be printed on a sheet P and extracts regions corresponding to the same drawing conditions. The function of the region extracting unit 141 is the same as the function of the region extracting unit 141 of the ink jet printing apparatus of the first embodiment. Accordingly, the description of the region extracting unit 141 will be omitted. Regions, which are extracted as the regions corresponding to the same drawing conditions, are regions having the same colors and the same amounts of ink.

Drawing Condition-Occupied Area Calculating Unit

The drawing condition-occupied area calculating unit 142 calculates occupied areas corresponding to the respective drawing conditions. The function of the drawing condition-occupied area calculating unit 142 is the same as the function of the drawing condition-occupied area calculating unit 142 of the ink jet printing apparatus of the first embodiment. Accordingly, the description of the drawing condition-occupied area calculating unit 142 will be omitted.

Individual Drying Intensity Calculating Unit

The individual drying intensity calculating unit 145 calculates drying intensity for each drawing condition by correcting reference drying intensity with a correction condition prescribed for each drawing condition. The calculated drying intensity corresponds to only a drawing condition where a region is extracted by the region extracting unit 141.

A procedure for calculating drying intensity is the same as the procedure for calculating drying intensity in the first embodiment. In the first embodiment, drying intensity has been calculated through the correction of reference drying intensity performed with the correction condition that corresponds to the drawing condition corresponding to the maximum occupied area. However, here, drying intensity is calculated for each drawing condition where a region is extracted by the region extracting unit 141.

The setting of reference drying intensity is also the same as that of the first embodiment. That is, reference drying intensity is set according to a printing condition.

Correction conditions are also prescribed in a table as in the first embodiment. That is, a table in which correction conditions (the amounts of correction) corresponding to the respective colors are prescribed and a table in which correction conditions (the amounts of correction) are prescribed for the respective amounts of ink are prepared.

The individual drying intensity calculating unit 145 obtains a correction condition for each drawing condition with reference to the tables and calculates drying intensity for each drawing condition by correcting reference drying intensity with the obtained correction condition. Drying intensity, which is obtained for each drawing condition, is referred to as "individual drying intensity".

FIG. 15 is a table showing examples of the calculation result of drying intensity corresponding to each drawing condition (individual drying intensity).

The table shown in FIG. 15 shows the calculation results of individual drying intensity in a case in which the image shown in FIG. 7 is printed. Correction conditions are correction conditions acquired from the tables shown in FIGS. 11 and 12. Further, reference drying intensity is set to "8".

According to FIG. 15, the individual drying intensity of the region A1 is set to "7", the individual drying intensity of the region A2 is set to "6", the individual drying intensity of the region A3 is set to "7", the individual drying intensity of the region A4 is set to "7", the individual drying intensity of the region A5 is set to "9", and the individual drying intensity of the region A6 is set to "7".

Drying Intensity-Occupied Area Calculating Unit

The drying intensity-occupied area calculating unit 146 groups the drawing conditions corresponding to the same drying intensities and calculates occupied areas for the respective drying intensities. That is, the drying intensity-occupied area calculating unit 146 sums up the occupied areas corresponding to the drawing conditions corresponding to the same individual drying intensities, and calculates the occupied areas corresponding to the respective drying intensities.

Figure 16:
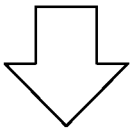
FIG. 16 is a table showing examples of the calculation result of an occupied area corresponding to each drying intensity.

FIG. 16 is a table showing examples of the calculation result of an occupied area corresponding to each drying intensity.

According to the calculation results of the individual drying intensity calculating unit 145, all the regions A1, A3, A4, and A6 are regions corresponding to the same drying intensity (individual drying intensity). That is, each of the regions A1, A3, A4, and A6 is a region of which the individual drying intensity is "7".

In regard to the regions A2 and A5, there is no region corresponding to the same individual drying intensity. Accordingly, the regions A2 and A5 are regions independent of each other.

Three individual drying intensities of "6", "7", and "9" are calculated. Accordingly, in the case of this example, occupied areas are calculated for the individual drying intensities of "6", "7", and "9".

The occupied area corresponding to the individual drying intensity of "7" is the sum of the occupied areas of the regions A1, A3, A4, and A6. That is, "S1+S3+S4+S6" is the occupied area corresponding to the individual drying intensity of "7".

The occupied area corresponding to the individual drying intensity of "6" is only the occupied area of the region A2. Accordingly, the occupied area corresponding to the individual drying intensity of "6" is the occupied area "S2" of the region A2.

The occupied area corresponding to the individual drying intensity of "9" is only the occupied area of the region A5. Accordingly, the occupied area corresponding to the individual drying intensity of "9" is the occupied area "S5" of the region A5.

Maximum Occupied Area-Drying Intensity Selecting Unit

The maximum occupied area-drying intensity selecting unit 147 selects drying intensity corresponding to the maximum occupied area on the basis of the calculation results of the drying intensity-occupied area calculating unit 146.

According to FIG. 16, the drying intensity corresponding to the maximum occupied area is "7". Accordingly, the individual drying intensity of "7" is selected in this case.

The drying intensity, which is selected by the maximum occupied area-drying intensity selecting unit 147, is set as the drying intensity of the ink drying section 50.

Drying Intensity Setting Method

Figure 17:
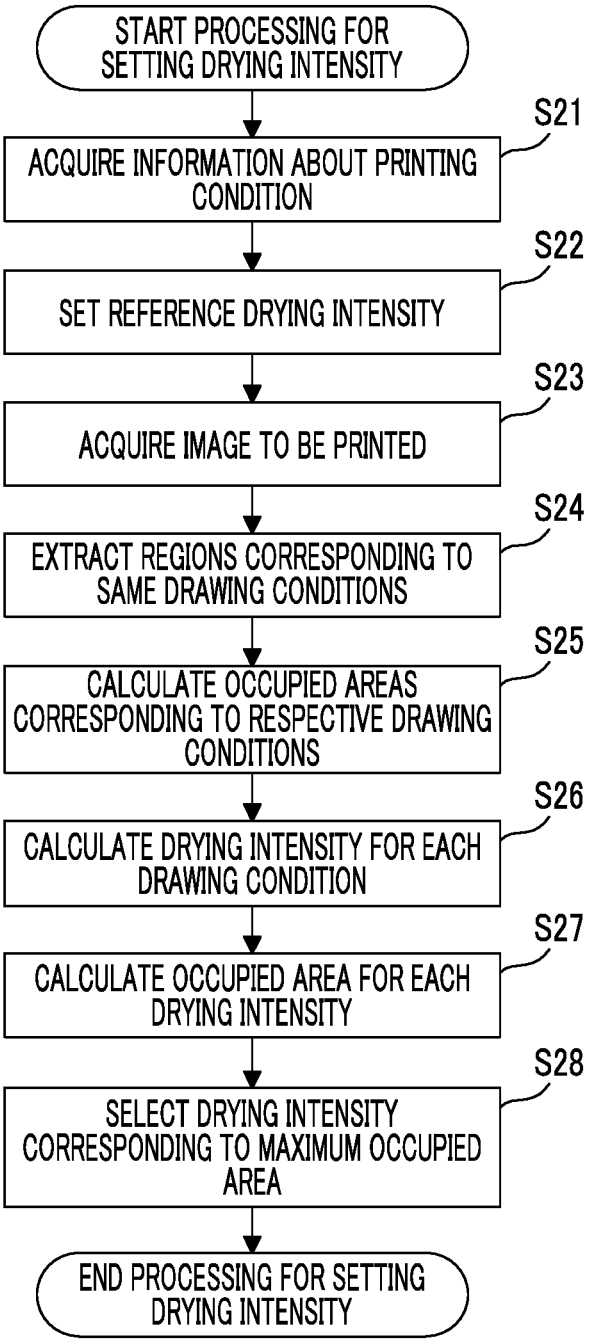
FIG. 17 is a flow chart showing a procedure for setting the drying intensity of the ink drying section.

FIG. 17 is a flow chart showing a procedure for setting the drying intensity of the ink drying section.

First, information about a printing condition is acquired to set reference drying intensity (Step S21). Here, information about the type of UV varnish, the type of a sheet, the thickness of a sheet, and the distinction of a printing surface is acquired. The information is input through the operation section 102 by a user.

Next, reference drying intensity is set on the basis of the acquired information about the printing condition (Step S22). The reference drying intensity is set with reference to a table on the basis of the information that is acquired as the printing condition.

Then, an image to be printed is acquired (Step S23). Here, print data is acquired. The print data is acquired from the image processing section 130.

Next, the acquired print data is analyzed and regions corresponding to the same drawing conditions are extracted (Step S24). Here, regions having the same colors and the same amounts of ink are extracted.

Then, the occupied areas corresponding to the respective drawing conditions are calculated (Step S25). That is, regions corresponding to the same drawing condition are combined as one region, and the occupied areas corresponding to the respective drawing conditions are calculated.

Next, drying intensity is calculated for each drawing condition (Step S26). That is, individual drying intensities are calculated. The individual drying intensity is calculated through the correction of the reference drying intensity performed with a correction condition that is prescribed for each drawing condition. The correction condition is acquired with reference to a table. The calculation of the individual drying intensity is performed for only a drawing condition where a region is extracted.

Then, the drawing conditions corresponding to the same drying intensities are grouped on the basis of the drying intensities prescribed for the respective drawing conditions (individual drying intensities), and occupied areas are calculated for the respective drying intensities (Step S27).

Next, drying intensity corresponding to the maximum occupied area is selected on the basis of the calculation results of the occupied areas corresponding to the respective drying intensities (Step S28). The selected drying intensity is set as the drying intensity of the ink drying section 50. Accordingly, drying intensity can be set on the basis of the widest range.

At the time of printing, the ink drying controller 115 operates the heating device 53 at the set drying intensity to dry the sheet P having been subjected to printing. Accordingly, the widest range can be dried while temperature where the sheet P reaches is in the prescribed range ($T1 \leq T \leq T2$). Therefore, the gloss of UV varnish to be applied in a subsequent step can be successfully ensured and the adhesiveness of UV varnish can also be successfully ensured. Further, the deformation of the sheet P can also be prevented and the occurrence of blocking can also be prevented.

Third Embodiment

In an ink jet printing apparatus of this embodiment, drying intensity is obtained by the method of the first embodiment and the obtained drying intensity is corrected as necessary. Correction will be performed as described below. That is, drying intensity is obtained by the method of the second embodiment, and the drying intensity obtained by the method of the first embodiment is changed to the drying intensity obtained by the method of the second embodiment in a case in which the obtained drying intensity is different from the drying intensity obtained by the method of the first embodiment.

The ink jet printing apparatus of this embodiment is merely different from the ink jet printing apparatus of the first embodiment only in that the ink jet printing apparatus of this embodiment further has a function to automatically correct drying intensity. Accordingly, only configuration relating to a function to automatically correct drying intensity will be described here.

Drying Intensity Setting Section

Figure 18:
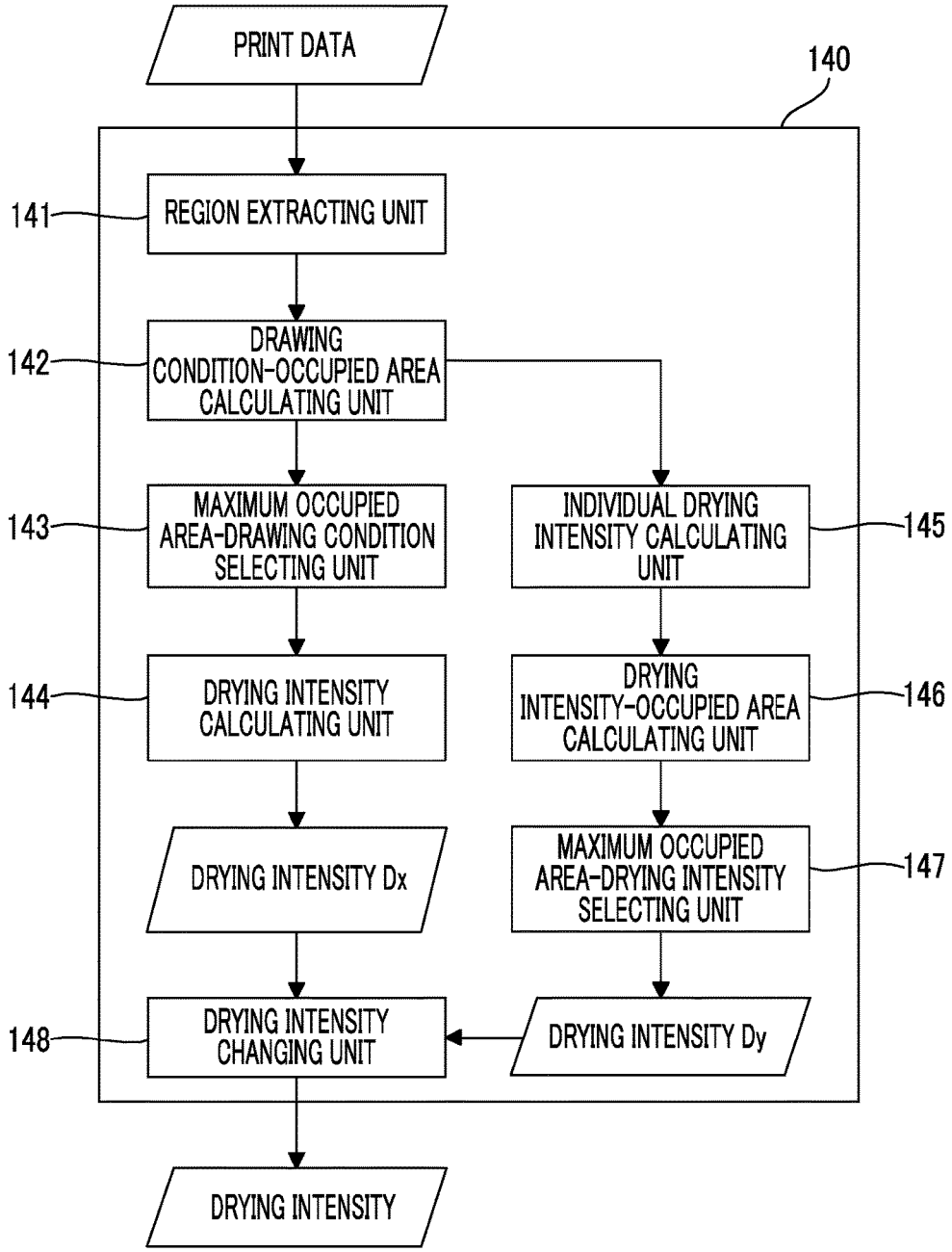
FIG. 18 is a block diagram of a drying intensity setting section having a correction function.

FIG. 18 is a block diagram of a drying intensity setting section having a correction function.

The drying intensity setting section 140 includes: a region extracting unit 141 that analyzes an image to be printed on a sheet and extracts regions corresponding to the same drawing conditions; a drawing condition-occupied area calculating unit 142 that calculates an occupied area corresponding to each drawing condition; a maximum occupied area-drawing condition selecting unit 143 that selects a drawing condition corresponding to the maximum occupied area; and a drying intensity calculating unit 144 that calculates drying intensity, which is to be set in the ink drying section 50, on the basis of the drawing condition selected by the maximum occupied area-drawing condition selecting unit 143. The drying intensity setting section 140 further includes: an individual drying intensity calculating unit 145 that calculates drying intensity for each drawing condition by correcting reference drying intensity with a correction condition prescribed for each drawing condition; a drying intensity-occupied area calculating unit 146 that groups the drawing conditions corresponding to the same drying intensities and calculates the occupied areas for the respective drying intensities; a maximum occupied area-drying intensity selecting unit 147 that selects drying intensity corresponding to the maximum occupied area; and a drying intensity changing unit 148 that compares the drying intensity, which is calculated by the drying intensity calculating unit 144, with the drying intensity, which is selected by the maximum occupied area-drying intensity selecting unit 147, and changes drying intensity, which is to be set in the ink drying section 50, to the drying intensity selected by the maximum occupied area-drying intensity selecting unit 147 in a case in which the drying intensity calculated by the drying intensity calculating unit 144 is different from the drying intensity selected by the maximum occupied area-drying intensity selecting unit 147.

The functions of the individual drying intensity calculating unit 145, the drying intensity-occupied area calculating unit 146, and the maximum occupied area-drying intensity selecting unit 147 are the same as the functions of the individual drying intensity calculating unit 145, the drying intensity-occupied area calculating unit 146, and the maximum occupied area-drying intensity selecting unit 147 of the drying intensity setting section of the above-mentioned second embodiment.

The drying intensity changing unit 148 compares drying intensity Dx, which is calculated by the drying intensity calculating unit 144, with drying intensity Dy, which is selected by the maximum occupied area-drying intensity selecting unit 147, and changes drying intensity, which is to be set in the ink drying section 50, to the drying intensity Dy selected by the maximum occupied area-drying intensity selecting unit 147 in a case in which the drying intensity Dx calculated by the drying intensity calculating unit 144 is different from the drying intensity Dy selected by the maximum occupied area-drying intensity selecting unit 147.

Drying Intensity Setting Method

Figure 19:
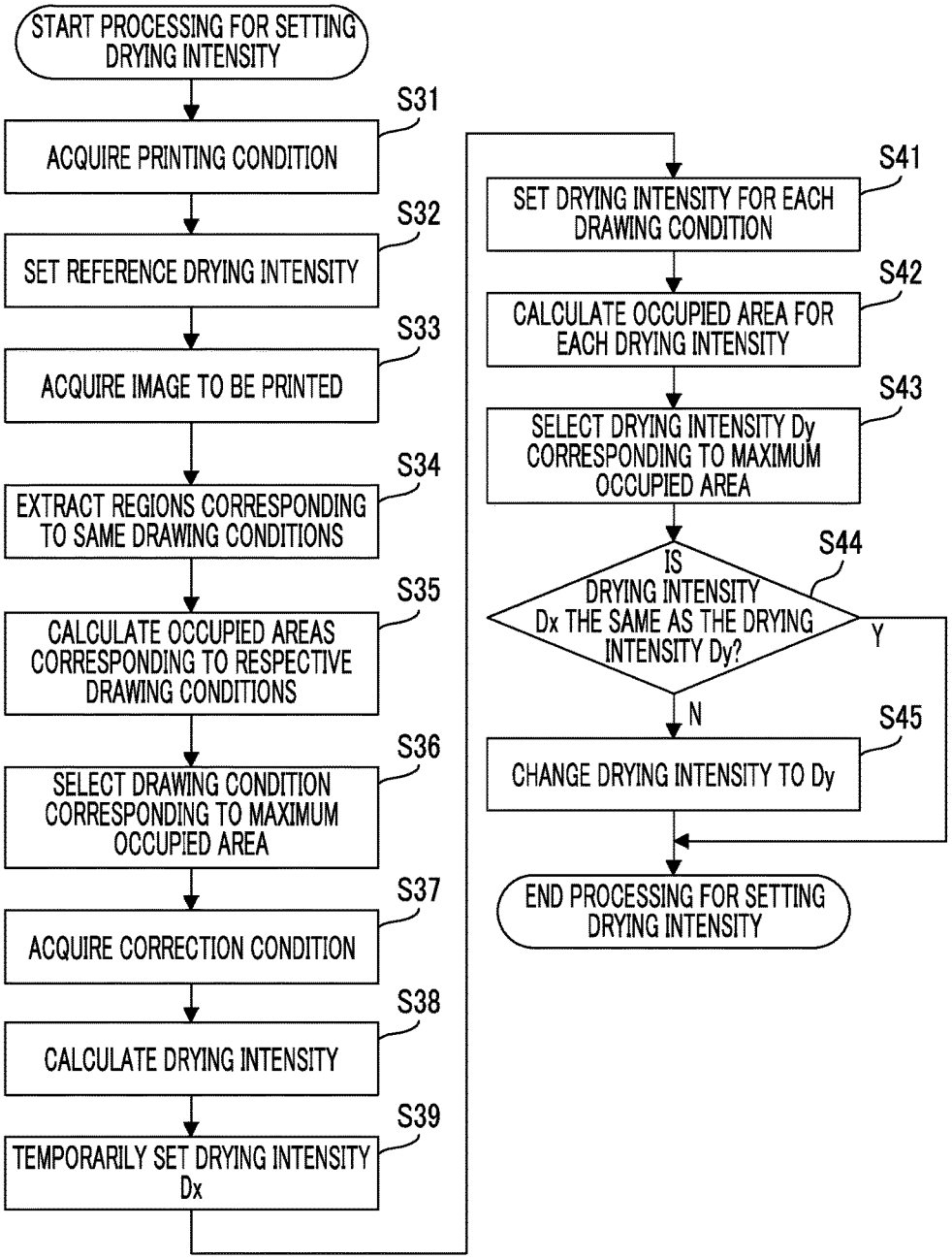
FIG. 19 is a flow chart showing a procedure for setting the drying intensity of the ink drying section.

FIG. 19 is a flow chart showing a procedure for setting the drying intensity of the ink drying section.

First, information about a printing condition is acquired to set reference drying intensity (Step S31). Here, information about the type of UV varnish, the type of a sheet, the thickness of a sheet, and the distinction of a printing surface is acquired. The information is input through the operation section 102 by a user.

Next, reference drying intensity is set on the basis of the acquired information about the printing condition (Step S32). The reference drying intensity is set with reference to a table on the basis of the information that is acquired as the printing condition.

Then, an image to be printed is acquired (Step S33). Here, print data is acquired. The print data is acquired from the image processing section 130.

Next, the acquired print data is analyzed and regions corresponding to the same drawing conditions are extracted (Step S34). Here, regions having the same colors and the same amounts of ink are extracted.

Then, the occupied areas corresponding to the respective drawing conditions are calculated (Step S35). That is, regions corresponding to the same drawing condition are combined as one region, and the occupied areas corresponding to the respective drawing conditions are calculated.

Next, a drawing condition corresponding to the maximum occupied area is selected on the basis of the calculated occupied areas corresponding to the respective drawing conditions (Step S36).

Then, a correction condition is acquired on the basis of a drawing condition that is selected as the drawing condition corresponding to the maximum occupied area (Step S37). The correction condition is acquired with reference to a table. That is, a correction condition corresponding to the selected drawing condition is read and acquired from a table.

Next, drying intensity, which is to be set in the ink drying section 50, is calculated through the correction of the setting of reference drying intensity performed with the acquired correction condition (Step S38). Then, the calculated drying intensity is temporarily set as the drying intensity that is to be set in the ink drying section 50 (Step S39). The temporarily set drying intensity is denoted by Dx.

Next, drying intensity is calculated for each drawing condition (Step S41). That is, individual drying intensities are calculated. The individual drying intensity is calculated through the correction of the reference drying intensity performed with a correction condition that is prescribed for each drawing condition.

Then, the drawing conditions corresponding to the same drying intensities are grouped on the basis of the drying intensities prescribed for the respective drawing conditions (individual drying intensities), and occupied areas are calculated for the respective drying intensities (Step S42).

Next, drying intensity corresponding to the maximum occupied area is selected on the basis of the calculation results of the occupied areas corresponding to the respective drying intensities (Step S43). The selected drying intensity is denoted by Dy.

Then, the temporarily set drying intensity Dx and the drying intensity Dy, which is selected as the drying intensity corresponding to the maximum occupied area, are compared with each other, and it is determined whether or not the drying intensity Dx is the same as the drying intensity Dy (Step S44).

If the temporarily set drying intensity Dx is the same as the drying intensity Dy, the drying intensity Dx is set as the drying intensity of the ink drying section 50 as it is.

On the other hand, if the temporarily set drying intensity Dx is not the same as the drying intensity Dy, the drying intensity to be set in the ink drying section 50 is changed to the drying intensity Dx (Step S45). Accordingly, drying intensity can be set on the basis of the widest range.

At the time of printing, the ink drying controller 115 operates the heating device 53 at the set drying intensity to dry the sheet P having been subjected to printing. Accordingly, the widest range can be dried while temperature where the sheet P reaches is in the prescribed range ($T1 \leq T \leq T2$). Therefore, the gloss of UV varnish to be applied in a subsequent step can be successfully ensured and the adhesiveness of UV varnish can also be successfully ensured. Further, the deformation of the sheet P can also be prevented and the occurrence of blocking can also be prevented.

Example of Setting of Drying Intensity

Figures 20, 21:
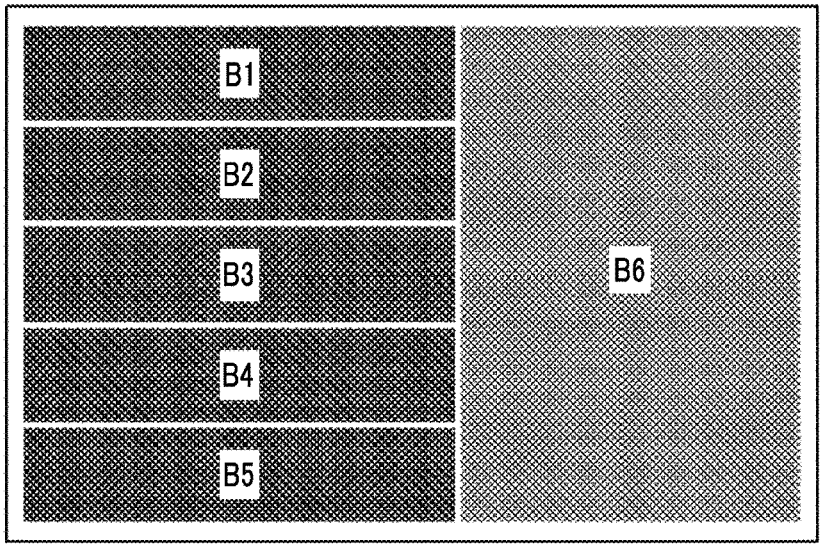
FIG. 20 is a diagram showing an example of an image to be printed.
FIG. 21 is a table showing a list of drawing conditions, occupied areas, individual drying intensities, and the like that are extracted, calculated, and the like on the basis of the image shown in FIG. 20.

FIG. 20 is a diagram showing an example of an image to be printed. FIG. 21 is a table showing a list of drawing conditions, occupied areas, individual drying intensities, and the like that are extracted, calculated, and the like on the basis of the image shown in FIG. 20.

The image shown in FIG. 20 is subjected to extraction processing, so that six regions B1 to B6 are extracted as regions corresponding to the same drawing conditions.

As shown in FIG. 21, the first region B1 is a region corresponding to a drawing condition in which a color is black (K) and the amount of ink is 3.4 pL. The second region B2 is a region corresponding to a drawing condition in which a color is black (K) and the amount of ink is 3.3 pL. The third region B3 is a region corresponding to a drawing condition in which a color is black (K) and the amount of ink is 3.2 pL. The fourth region B4 is a region corresponding to a drawing condition in which a color is black (K) and the amount of ink is 3.1 pL. The fifth region B5 is a region corresponding to a drawing condition in which a color is black (K) and the amount of ink is 3.0 pL. The sixth region B6 is a region corresponding to a drawing condition in which a color is blue (B) and the amount of ink is 5.0 pL.

In a case in which individual drying intensities are obtained for the respective regions, the individual drying intensity of the first region B1 is calculated as "6", the individual drying intensity of the second region B2 is calculated as "6", the individual drying intensity of the third region B3 is calculated as "6", the individual drying intensity of the fourth region B4 is calculated as "6", the individual drying intensity of the fifth region B5 is calculated as "6", and the individual drying intensity of the sixth region B6 is calculated as "10".

A drawing condition having the maximum occupied area is the drawing condition of the sixth region B6. Accordingly, the temporary drying intensity Dx is set to "10" that is the individual drying intensity of the sixth region B6.

In a case in which occupied areas are obtained for the respective drying intensities, the drying intensity Dy having the maximum occupied area is "6".

In a case in which the drying intensity Dx and the drying intensity Dy are compared with each other, the drying intensity Dx is not the same as the drying intensity Dy. Accordingly, drying intensity is changed to Dy in this case.

Fourth Embodiment

In the ink jet printing apparatuses of the first to third embodiment, drying intensity to be set in the ink drying section 50 is automatically set on the basis of an image to be printed. An ink jet printing apparatus of this embodiment has a function to allow a user to manually correct automatically set drying intensity.

The ink jet printing apparatus of this embodiment is the same as the ink jet printing apparatuses of the first to third embodiments except that the ink jet printing apparatus of this embodiment has a correction function. Accordingly, only the function to allow a user to manually correct automatically set drying intensity will be described here.

Manual Correction Function

As a function to correct automatically set drying intensity, the ink jet printing apparatus of this embodiment has a function to forcibly change automatically set drying intensity to the drying intensity of a region of an image, in which the lowest drying intensity is required, according to an instruction from a user, a function to forcibly change automatically set drying intensity to the drying intensity of a region of an image, in which the highest drying intensity is required, according to an instruction from a user, and a function to correct automatically set drying intensity to drying intensity corresponding to the instruction from a user.

Figure 22:
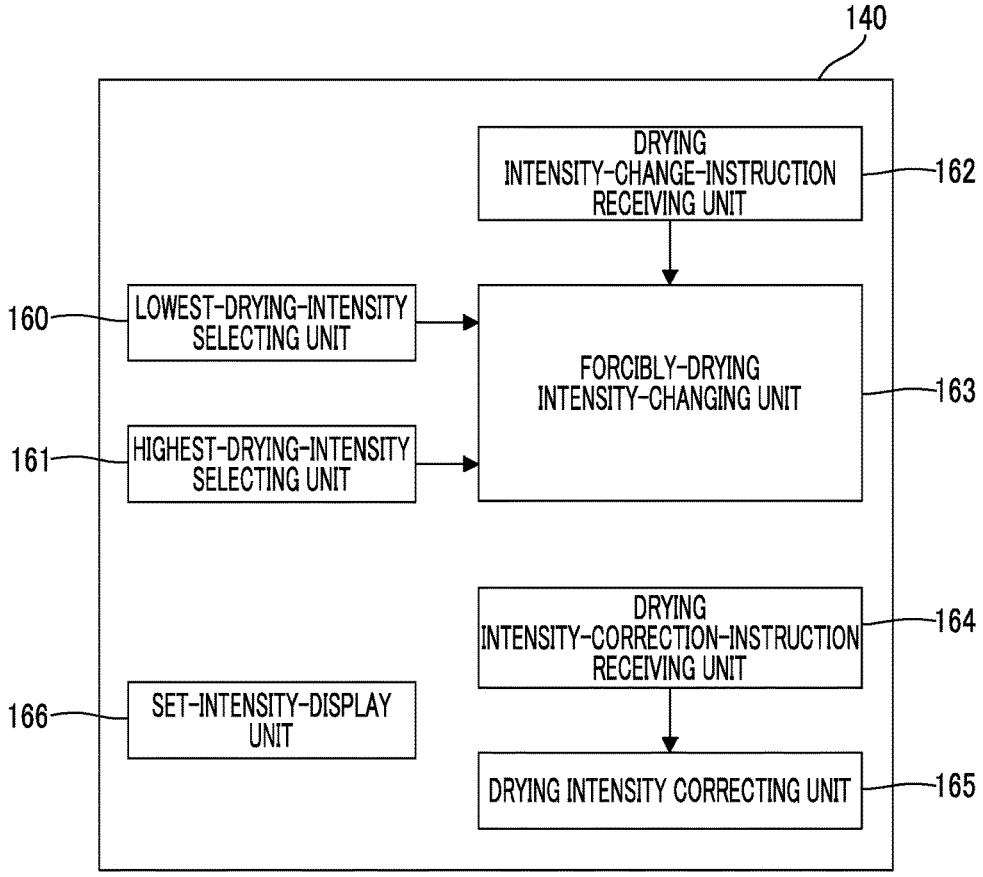
FIG. 22 is a block diagram of functions relating to the correction of drying intensity.

FIG. 22 is a block diagram of functions relating to the correction of drying intensity.

The drying intensity setting section 140 further includes: a lowest-drying-intensity selecting unit 160 that selects the lowest drying intensity among drying intensities calculated for the respective drawing conditions; a highest-drying-intensity selecting unit 161 that selects the highest drying intensity among drying intensities calculated for the respective drawing conditions; a drying intensity-change-instruction receiving unit 162 that receives an instruction for changing drying intensity to the lowest drying intensity or the highest drying intensity; and a forcibly-drying intensity-changing unit 163 that forcibly changes drying intensity, which is to be set in the ink drying section 50, according to the received instruction in a case in which the drying intensity-change-instruction receiving unit 162 receives the instruction for changing drying intensity. The drying intensity setting section 140 further includes: a drying-intensity-correction-instruction receiving unit 164 that receives an instruction for correcting drying intensity to be set in the ink drying section 50; and a drying intensity correcting unit 165 that corrects drying intensity, which is to be set in the ink drying section 50, according to the received instruction in a case in which the drying-intensity-correction-instruction receiving unit 164 receives the instruction for correcting drying intensity. The drying intensity setting section 140 further includes: a set-intensity-display unit 166 that displays drying intensity to be set in the ink drying section 50.

Lowest-Drying-Intensity Selecting Unit

The lowest-drying-intensity selecting unit 160 selects the lowest drying intensity among drying intensities calculated for the respective drawing conditions. That is, the lowest-drying-intensity selecting unit 160 obtains the drying intensity of a region of an image to be printed, in which the lowest drying intensity is required, as the lowest drying intensity. Since the drying intensities corresponding to the respective drawing conditions are acquired as individual drying intensities, the lowest-drying-intensity selecting unit 160 selects the lowest drying intensity among the individual drying intensities to select the lowest drying intensity. Information about the selected drying intensity is output to the forcibly-drying intensity-changing unit 163. The function of the lowest-drying-intensity selecting unit 160 is achieved through the execution of a predetermined program that is performed by the computer 100.

Highest-Drying-Intensity Selecting Unit

The highest-drying-intensity selecting unit 161 selects the highest drying intensity among the drying intensities calculated for the respective drawing conditions. That is, the highest-drying-intensity selecting unit 161 obtains the drying intensity of a region of an image to be printed, in which the highest drying intensity is required, as the highest drying intensity. The highest-drying-intensity selecting unit 161 selects the highest drying intensity among the individual drying intensities to select the highest drying intensity. Information about the selected drying intensity is output to the forcibly-drying intensity-changing unit 163. The function of the highest-drying-intensity selecting unit 161 is achieved through the execution of a predetermined program that is performed by the computer 100.

Drying Intensity-Change-Instruction Receiving Unit

The drying intensity-change-instruction receiving unit 162 receives an instruction for changing drying intensity to the lowest drying intensity or the highest drying intensity. The drying intensity-change-instruction receiving unit 162 receives an instruction through the operation section 102. For example, the drying intensity-change-instruction receiving unit 162 receives an instruction from a touch panel.

Forcibly-Drying Intensity-Changing Unit

The forcibly-drying intensity-changing unit 163 forcibly changes drying intensity, which is to be set in the ink drying section 50, according to the received instruction in a case in which the drying intensity-change-instruction receiving unit 162 receives the instruction for changing drying intensity. For example, in a case in which the change of drying intensity to the lowest drying intensity is instructed, the forcibly-drying intensity-changing unit 163 changes the automatically set drying intensity to the drying intensity that is selected by the lowest-drying-intensity selecting unit 160. Further, for example, in a case in which the change of drying intensity to the highest drying intensity is instructed, the forcibly-drying intensity-changing unit 163 changes the automatically set drying intensity to the drying intensity that is selected by the highest-drying-intensity selecting unit 161. The function of the forcibly-drying intensity-changing unit 163 is achieved through the execution of a predetermined program that is performed by the computer 100.

Drying-Intensity-Correction-Instruction Receiving Unit

The drying-intensity-correction-instruction receiving unit 164 receives an instruction for correcting drying intensity to be set in the ink drying section 50. The drying-intensity-correction-instruction receiving unit 164 receives an instruction through the operation section 102. For example, the drying-intensity-correction-instruction receiving unit 164 receives an instruction from a touch panel. The instruction of correction is performed by the input of the amount of correction to the current set drying intensity. For example, the instruction of +1, −1, or the like is performed.

Drying Intensity Correcting Unit

The drying intensity correcting unit 165 corrects drying intensity, which is to be set in the ink drying section 50, according to the received instruction in a case in which the drying-intensity-correction-instruction receiving unit 164 receives the instruction for correcting drying intensity. The function of the drying intensity correcting unit 165 is achieved through the execution of a predetermined program that is perfoinied by the computer 100.

Set-Intensity-Display Unit

The set-intensity-display unit 166 displays drying intensity to be set in the ink drying section 50. The set-intensity-display unit 166 can also be used as the display section 103. Further, the set-intensity-display unit 166 can be formed of a touch panel and can also be adapted to be used as both the drying intensity-change-instruction receiving unit 162 and the drying-intensity-correction-instruction receiving unit 164.

Processing for Correcting Drying Intensity

Figure 23:
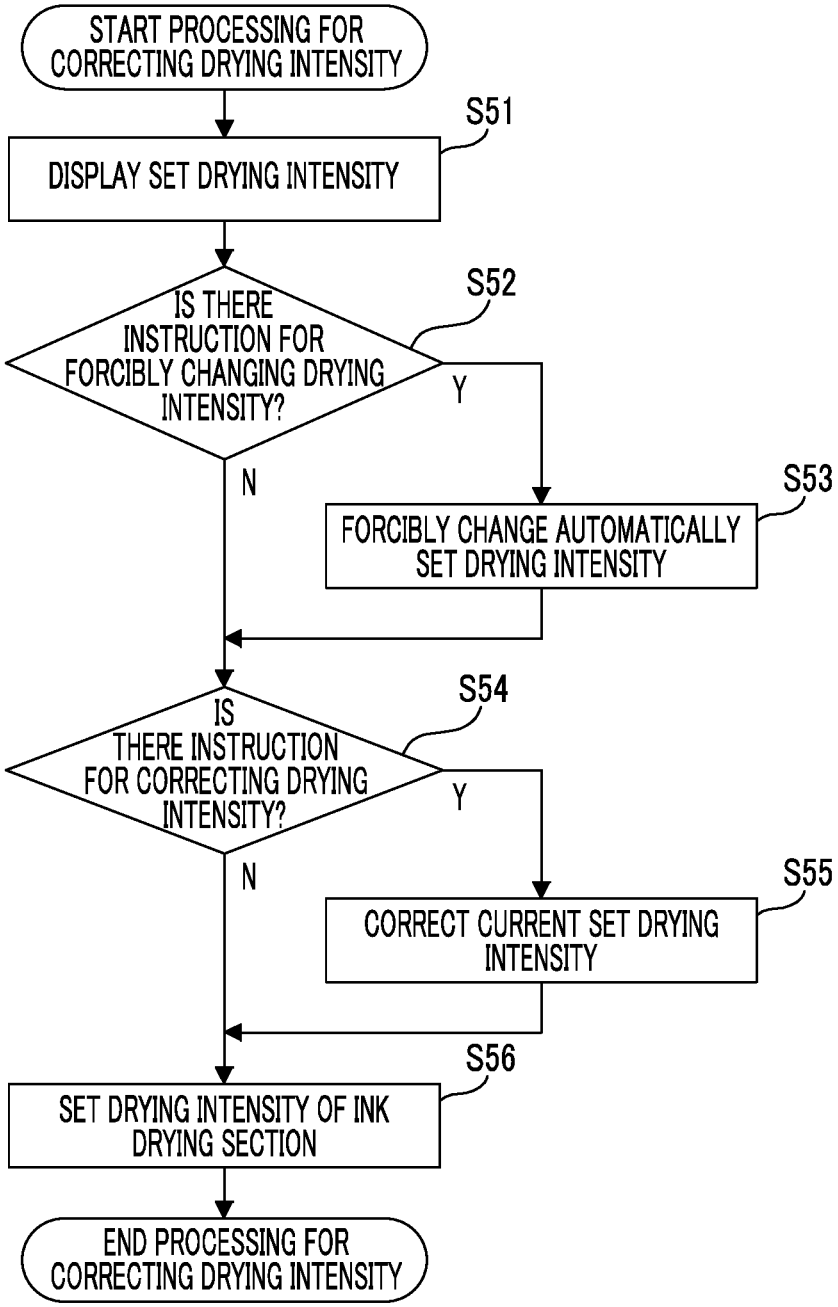
FIG. 23 is a flow chart showing a procedure of processing for correcting drying intensity.

FIG. 23 is a flow chart showing a procedure of processing for correcting drying intensity.

Automatically set drying intensity is displayed on the set-intensity-display unit 166 (Step S51). Accordingly, the current set drying intensity can be confirmed from the display of the set-intensity-display unit 166.

In a case in which a user sets drying intensity so that the drying intensity corresponds to a region of an image in which the lowest drying intensity is required or a case in which a user sets drying intensity so that the drying intensity corresponds to a region of an image in which the highest drying intensity is required, the user gives an instruction for setting drying intensity as described above from operation section 102. Further, even in a case in which a user finely adjusts drying intensity, the user gives an instruction for finely adjusting drying intensity from operation section 102.

First, it is determined whether or not there is an instruction for forcibly changing drying intensity (Step S52). That is, it is determined whether or not there is an instruction for changing drying intensity to the lowest drying intensity or the highest drying intensity.

If there is an instruction for forcibly changing drying intensity, the drying intensity is changed to drying intensity corresponding to the instruction (Step S53). For example, if the change of drying intensity to the lowest drying intensity is instructed, drying intensity is changed to the drying intensity that is selected by the lowest-drying-intensity selecting unit 160. Further, if the change of drying intensity to the highest drying intensity is instructed, drying intensity is changed to the drying intensity that is selected by the highest-drying-intensity selecting unit 161.

If there is no instruction for forcibly changing drying intensity, it is then determined whether or not there is an instruction for correcting drying intensity (Step S54). If there is an instruction for correcting drying intensity, the current set drying intensity is corrected with the amount of correction corresponding to the instruction (Step S55).

As described above, the correction of drying intensity is completed and drying intensity at the time of printing is finally set (Step S56).

Since the ink jet printing apparatus of this embodiment has the manual correction function as described above, setting according to a user's demand can be performed. For example, it is preferable that drying intensity is set as low as possible in a case in which the adhesiveness of UV varnish is regarded as most important, and it is preferable that drying intensity is set as high as possible in a case in which the glossiness of UV varnish is regarded as most important. Accordingly, since the ink jet printing apparatus does not automatically set drying intensity in all situations and has a function to be capable of correcting drying intensity depending on the situation, the ink jet printing apparatus can print a printed article having a quality according to a user's demand.

The ink jet printing apparatus has both a function to forcibly change drying intensity and a function to correct drying intensity in this embodiment, but may be adapted to have only one of the functions.

Fifth Embodiment

A region in which temperature where a sheet reaches exceeds a prescribed range may be generated in a case in which a certain image is dried at set drying intensity. In such a case, the generation of the region in which temperature where a sheet reaches exceeds a prescribed range can be suppressed through the adjustment of the transport speed of a sheet P and drying intensity. Specifically, drying intensity is reduced and the transport speed of a sheet P is reduced. In this case, drying intensity and the transport speed are set so that the same drying rate as the drying rate before the change is obtained.

Configuration

Figure 24:
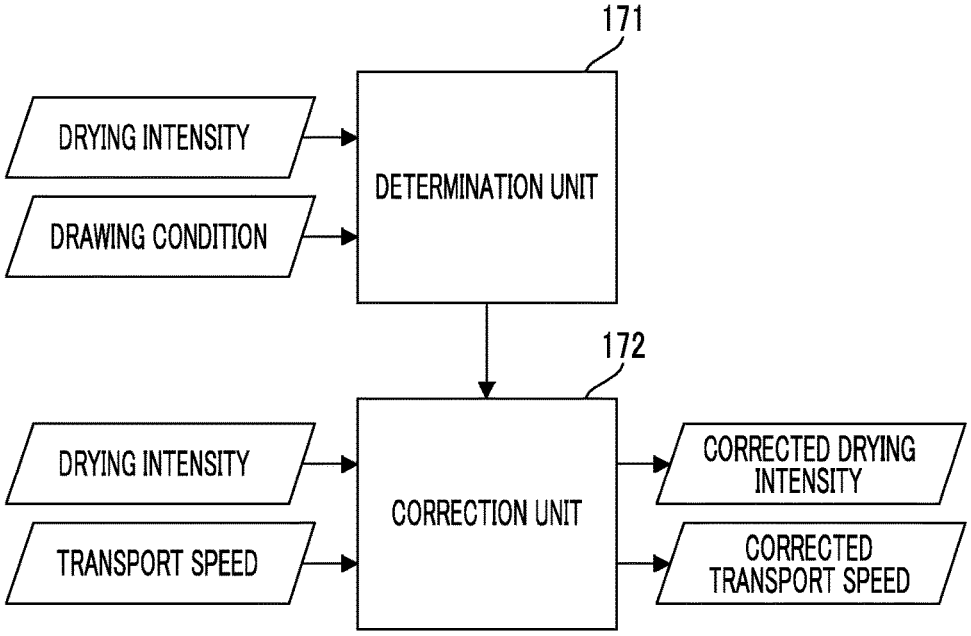
FIG. 24 is a block diagram of functions relating to the correction of drying intensity and transport speed.

FIG. 24 is a block diagram of functions relating to the correction of drying intensity and transport speed.

As shown in FIG. 24, an ink jet printing apparatus of this embodiment further includes: a determination unit 171 that determines whether or not a region in which temperature where a sheet P reaches exceeds a prescribed range is present in a case in which the ink drying section 50 is operated at set drying intensity; and a correction unit 172 that corrects the transport speed of the sheet P and drying intensity so that the temperature where the sheet P reaches is in the prescribed range in a case in which the region in which temperature where the sheet P reaches exceeds the prescribed range is present. The function of each unit is achieved through the execution of a predetennined program that is performed by the computer 100.

Determination Unit

The determination unit 171 determines whether or not a region in which temperature where a sheet P reaches exceeds a prescribed range is present in a case in which the ink drying section 50 is operated at set drying intensity. The determination unit 171 determines whether or not a region in which temperature where a sheet P reaches exceeds a prescribed range is present on the basis of the information about the drawing conditions of the respective regions that are extracted by the region extracting unit 141 and the information about the set drying intensity. For example, the determination unit 171 estimates temperature where a sheet reaches for each drawing condition, and determines whether or not a region in which temperature where the sheet reaches exceeds a prescribed range is present.

Correction Unit

The correction unit 172 corrects the transport speed of the sheet P and drying intensity so that the temperature where the sheet P reaches is in the prescribed range in a case in which the region in which temperature where the sheet P reaches exceeds the prescribed range is present. In this case, drying intensity and the transport speed are corrected so that the same drying rate as the drying rate before the correction is obtained. Specifically, drying intensity is reduced and the transport speed is reduced. Accordingly, a rise in temperature where a sheet P reaches can be suppressed.

Correction Procedure

A correction processing is performed before the start of printing.

First, the determination unit 171 determines whether or not a region in which temperature where a sheet P reaches exceeds a prescribed range is present in a case in which drying processing is performed at the current setting.

In a case in which a region in which temperature where a sheet P reaches exceeds a prescribed range is not present, printing is started as it is.

On the other hand, in a case in which a region in which temperature where a sheet P reaches exceeds a prescribed range is present, the correction unit 172 performs processing for correcting drying intensity and transport speed. That is, the transport speed of the sheet P and drying intensity are corrected so that the temperature where the sheet P reaches is in the prescribed range.

Accordingly, it is possible to prevent the temperature where the sheet reaches from exceeding the prescribed range over the entire sheet P.

Prescribed Range of Temperature where Sheet Reaches

In a case in which temperature where a sheet reaches at the time of drying of ink is too low, the solvent of ink, which does not sufficiently permeate the sheet, is mixed to the film of UV varnish and gloss deteriorates. The deterioration of gloss causes the quality of a printed article to deteriorate. Further, the incomplete curing of UV varnish is caused in a case in which the solvent of ink is mixed to UV varnish. The incomplete curing of UV varnish causes blocking.

On the other hand, in a case in which the temperature of a sheet at the time of drying of ink is too high, the moisture of the sheet volatilizes and deformation, such as curl or cockle, occurs on the sheet.

For the prevention of the generation of these problems, drying processing needs to be performed so that temperature where a sheet reaches is in a prescribed range. In a case in which the lower limit of temperature at which the deterioration of the gloss of UV varnish can be prevented and blocking can be prevented is denoted by T1 and the upper limit of temperature at which the deterioration of the adhesiveness of UV varnish can be prevented and the deformation of a sheet can be prevented is denoted by T2, this temperature is in the range of T1 to T2 ($T1 \leq T \leq T2$).

The lower limit T1 is changed depending on the type of UV varnish, the type of the sheet, the thickness of the sheet, the distinction of a printing surface, or the like. Therefore, the lower limit T1 is not determined as a specific numerical value and needs to be adjusted depending on combinations of the respective conditions.

It is preferable that the upper limit T2 is set to be lower than 100° C. since the boiling point of moisture is 100° C. However, since it may be difficult to deform a certain type of a sheet, the temperature T2 can also be set to 100° C. or more.

In a case in which temperature where a sheet reaches at the time of drying of ink including wax exceeds the melting point of the wax, the wax is eluted on the surface of the film of the ink and causes the adhesiveness between the film of ink and the film of UV varnish to deteriorate. Accordingly, it is preferable that the upper limit T2 is set to T2*a* in a case in which ink includes wax. Here, the upper limit T2*a* is the melting point of the wax. T2*a* naturally varies depending on the kind of the wax. Further, in a case in which T2*a* is lower than T2, the upper limit of temperature where a sheet reaches after the drying of ink is the melting point of the wax.

Evaluation

Ink was dried with the change of drying intensity and UV varnish was applied to perform experiments for confirming an influence on the quality of an image.

In a case in which varnish coating is performed using UV varnish, an influence of drying intensity at the time of drying of ink on the quality of an image mainly includes the adhesiveness of varnish, the glossiness of varnish, and blocking during storage. For this reason, experiments evaluating the adhesiveness of varnish, the glossiness of varnish, and a blocking property during storage were performed. Further, the curl of a sheet, in a case in which drying intensity was changed, was also evaluated.

Evaluation Method

Method of Evaluating Adhesiveness of Varnish

Stripe images, which have a width of 50 mm and have a color of 4C, and stripe images, which have a width of 50 mm and have a blue color, are printed on one surface of a sheet, and the surfaces of the images are coated with UV varnish. A cellophane tape (manufactured by Nichiban Co., Ltd.) having a width of 18 mm and a length of about 40 mm is attached to the surfaces of the images to which varnish is applied. The attached cellophane tape is pulled in a vertical direction, the separation state of the layer of varnish from the surface of the layer of ink is confirmed, and the adhesiveness of varnish is evaluated in three stages. Evaluation standards are as follows.

A: varnish is not separated or the sheet is torn

B: varnish is partially separated

C: varnish is separated over the surface of the sheet

Evaluation A is evaluation in which the adhesiveness of varnish can be determined as good. Evaluations B and C are evaluations in which the adhesiveness of varnish is not allowable.

Method of Evaluating Glossiness of Varnish

Stripe images, which have a width of 50 mm and have a color of 4C, and stripe images, which have a width of 50 mm and have a blue color, are printed on one surface of a sheet, and the surfaces of the images are coated with UV varnish. The gloss of the surfaces of the images to which varnish is applied is measured at a measurement angle of 60°, and the glossiness of varnish is evaluated in three stages. Evaluation standards are as follows.

A: 70 or more

B: 56 to 69

C: 55 or less

A glossmeter "micro-tri-gross" manufactured by O-Well Corporation was used to measure glossiness.

Evaluation A is evaluation in which the glossiness of varnish can be determined as good. Evaluations B and C are evaluations in which the glossiness of varnish is not allowable.

Method of Evaluating Blocking Property

Stripe images, which have a width of 50 mm and have a color of 4C, and stripe images, which have a width of 50 mm and have a blue color, are printed on one surface of a sheet, and the surfaces of the images are coated with UV varnish. The printed sheet is cut into a size of 3.5 cm×4.0 cm. Cut sheets are used as samples, and ten samples are interposed between acrylic plates while overlapping each other. In this case, all the samples overlap each other so that the surface of each sample to which varnish is applied faces up. The acrylic plates are placed on a horizontal base, a weight having a mass of 7 kg is placed on the acrylic plate to apply weight to the acrylic plate, and the samples are left under the environment of a temperature of 50° C. and a humidity of 80% for 24 hours. After that, the samples are further left under the environment of a temperature of 23° C. and a humidity of 50% for 24 hours. The samples are separated from each other, the occurrence state of blocking is confirmed, and a blocking property is evaluated in three stages. Evaluation standards are as follows.

A: blocking does not occur

B: blocking slightly occurs when being visually observed

C: blocking obviously occurs when being visually observed

Evaluation A is evaluation in which a blocking property during storage can be determined as good. Evaluations B and C are evaluations in which a blocking property during storage is not allowable.

That is, the evaluation is the evaluation of an allowable range.

Method of Evaluating Curl

Solid images, which have a color of 4C, and solid images, which have a blue color, are printed on one surface of a sheet, and the surfaces of the images are coated with UV varnish. One printed sheet is placed on a flat base, the rise distances of four corners of the sheet are measured, and an average of the measured rise distances is evaluated in three stages as the degree of curl. Evaluation standards are as follows.

A: less than 10 mm

B: 10 mm or more and less than 20 mm

C: 20 mm or more

Evaluation A is evaluation in which curl can be determined as good. Evaluations B and C are evaluations in which curl is not allowable.

Experiment Conditions

The sheet used in the experiments is "newDV310gsm" manufactured by Hokuetsu Kishu Paper Co., Ltd. The thickness of the sheet is 0.38 mm. The sheet has a size of 750 mm×530 mm.

UV varnish used in the experiments is "UV Coating Varnish TG-2" manufactured by T&K TOKA Corporation.

Two types of ink, that is, ink including wax and ink not including wax were used as ink. The wax content of the ink including wax is 2 mass %. The melting point of wax was measured by a differential scanning calorimetry (DSC), and was 83° C. Each of the amount of ink having a color of 4C and the amount of having a blue color was 4.8 pL.

Printing was performed on one surface of a sheet (surface printing).

Experimental Results

FIGS. 25 to 28 are tables of experimental results. Here, FIG. 25 is a table of experimental results in a case in which an image of 4C is printed with ink including wax. FIG. 26 is a table of experimental results in a case in which a blue image is printed with ink including wax. FIG. 27 is a table of experimental results in a case in which an image of 4C is printed with ink not including wax. FIG. 28 is a table of experimental results in a case in which a blue image is printed with ink not including wax.

As shown in FIGS. 25 to 28, in a case in which temperature where a sheet reaches is made to be in a certain range ($T1 \leq T \leq T2$), the adhesiveness of varnish and the glossiness of varnish can be successfully ensured and blocking during storage can be prevented. Further, the generation of curl can be prevented.

As shown in FIGS. 25 to 28, the adhesiveness of varnish deteriorates as the density of ink is increased. The reason for this is that the amount of ink to be jetted is increased with an increase in the density of ink and the amount of wax included in an image is increased. Further, since the temperature of the surface of the film of an ink having a blackish color is most likely to rise at the time of drying of the ink, wax is likely to be unevenly distributed on the surface of the ink. That is, a condition, which is strictest in regard to the adhesion performance of UV varnish, is a case in which an ink having a blackish color is used and the amount of the ink to be jetted is largest; and is the case of 4C in which all the inks having four colors are used and a highly dense black color is expressed.

Change of Quality of an Image in a Case in which Drying Intensity and Transport Speed are Changed Experiments for confirming the change of the quality of an image in a case in which drying intensity and transport speed are changed were performed.

An evaluation method is the same as described above. Ink including wax was used as ink.

FIG. 29 shows experimental results in a case in which an image of 4C is printed. FIG. 30 shows experimental results in a case in which a blue image is printed.

Level 5 is a condition in which the transport speed of Level 3 is reduced substantially in half and the drying intensity of Level 3 is reduced in half. The amount of applied heat of Level 5 is substantially the same as that of Level 3. Since temperature where a sheet reaches is lowered, it can be confirmed that adhesiveness and curl are improved.

A relationship between Level 4 and Level 6 is also the same as described above, and Level 6 is a condition in which the transport speed of Level 4 is reduced substantially in half and the drying intensity of Level 4 is reduced in half Since temperature where a sheet reaches is lowered even in this case, it can be confirmed that adhesiveness and curl are improved.

Accordingly, it is possible to prevent the deterioration of the quality of an image by reducing the transport speed of s sheet and reducing drying intensity as necessary in a case in which a region in which temperature where a sheet reaches exceeds a prescribed range is generated.

EXPLANATION OF REFERENCES

1: ink jet printing apparatus
10: sheet feeding section
11: sheet feeding device
12: feeder board
13: sheet feeding drum
20: pre-coating section
21: pre-coating drum
22: pre-coating liquid applying device
30: pre-coating liquid drying section
31: pre-coating liquid drying drum
32: pre-coating liquid drying section-sheet guide
33: dryer
40: printing section
41: printing drum
42: sheet pressing roller
43: printing unit
44C: ink jet head
44K: ink jet head
44M: ink jet head
44Y: ink jet head
45: image reading device
50: ink drying section
51: ink drying section-chain delivery
52: ink drying section-sheet guide
53: heating device
60: varnish coating section
61: varnish coating drum
70: UV irradiation section
71: UV irradiation section-chain delivery
72: UV irradiation section-sheet guide
73: UV irradiation device
80: collection section
81: stacker
90: varnish coater
91: varnish tank
92: draw-up roller
93: metering blade
94: first intermediate transfer roller
95: second intermediate transfer roller
96: varnish applying roller
100: computer
101: interface section
102: operation section
103: display section
104: storage section
111: sheet feed controller
112: pre-coating controller
113: pre-coating liquid drying controller
114: printing controller
115: ink drying controller
116: varnish coating controller
117: UV irradiation controller
118: collection controller
130: image processing section
131: color conversion processing unit
132: halftoning unit
140: drying intensity setting section
141: region extracting unit
142: drawing condition-occupied area calculating unit
143: maximum occupied area-drawing condition selecting unit
144: drying intensity calculating unit
145: individual drying intensity calculating unit
146: drying intensity-occupied area calculating unit
147: maximum occupied area-drying intensity selecting unit
148: drying intensity changing unit
150: reference drying intensity setting section
160: lowest-drying-intensity selecting unit
161: highest-drying-intensity selecting unit
162: drying intensity-change-instruction receiving unit
163: forcibly-drying intensity-changing unit
164: drying-intensity-correction-instruction receiving unit
165: drying intensity correcting unit
166: set-intensity-display unit
171: determination unit
172: correction unit
P: sheet
S11 to S18: procedure for setting drying intensity of ink drying section
S21 to S28: procedure for setting drying intensity of ink drying section
S31 to S45: procedure for setting drying intensity of ink drying section
S51 to S56: procedure for correcting drying intensity

What is claimed is:

1. An ink jet printing apparatus comprising:

a printing section that prints an image on a sheet with aqueous ink by an ink jet method;

an ink drying section that dries the ink by heating the sheet having been subjected to printing;

a drying intensity setting section that sets drying intensity of the ink drying section and sets the drying intensity to intensity in which temperature where the sheet reaches is in a prescribed range; and a varnish coating section that coats the sheet of which the ink has been dried with UV varnish, wherein the drying intensity setting section includes a region extracting unit that analyzes an image to be printed on the sheet and extracts regions corresponding to the same drawing conditions prescribed by colors and the amount of ink, a drawing condition-occupied area calculating unit that calculates occupied areas corresponding to the respective drawing conditions, a maximum occupied area-drawing condition selecting unit that selects a drawing condition corresponding to the maximum occupied area, and a drying intensity calculating unit that obtains a correction condition corresponding to the drawing condition, which is selected by the maximum occupied area-drawing condition selecting unit, with reference to correction conditions prescribed for the respective drawing conditions and calculates drying intensity by correcting reference drying intensity with the obtained correction condition, and the drying intensity calculated by the drying intensity calculating unit is set as the drying intensity of the ink drying section.

2. The ink jet printing apparatus according to claim 1, wherein the drying intensity setting section further includes an individual drying intensity calculating unit that calculates drying intensity for each drawing condition by correcting the reference drying intensity with the correction condition prescribed for each drawing condition, a drying intensity-occupied area calculating unit that groups drawing conditions corresponding to the same drying intensities and calculates occupied areas for the respective drying intensities, a maximum occupied area-drying intensity selecting unit that selects drying intensity corresponding to the maximum occupied area, and a drying intensity changing unit that compares the drying intensity, which is calculated by the drying intensity calculating unit, with the drying intensity, which is selected by the maximum occupied area-drying intensity selecting unit, and changes drying intensity, which is to be set in the ink drying section, to the drying intensity selected by the maximum occupied area-drying intensity selecting unit in a case in which the drying intensity calculated by the drying intensity calculating unit is different from the drying intensity selected by the maximum occupied area-drying intensity selecting unit.

3. The ink jet printing apparatus according to claim 2, further comprising:

a lowest-drying-intensity selecting unit that selects the lowest drying intensity among the drying intensities calculated for the respective drawing conditions;

a highest-drying-intensity selecting unit that selects the highest drying intensity among the drying intensities calculated for the respective drawing conditions;

a drying intensity-change-instruction receiving unit that receives an instruction for changing drying intensity to the lowest drying intensity or the highest drying intensity; and a forcibly-drying intensity-changing unit that forcibly changes drying intensity, which is to be set in the ink drying section, according to the received instruction in a case in which the drying intensity-change-instruction receiving unit receives the instruction for changing drying intensity.

4. The ink jet printing apparatus according to claim 1, further comprising:

a set-intensity-display unit that displays drying intensity to be set in the ink drying section;

a drying-intensity-correction-instruction receiving unit that receives an instruction for correcting drying intensity to be set in the ink drying section; and a drying intensity correcting unit that corrects drying intensity, which is to be set in the ink drying section, according to the received instruction in a case in which the drying-intensity-correction-instruction receiving unit receives the instruction for correcting drying intensity.

5. The ink jet printing apparatus according to claim 1, wherein the region extracting unit excludes a region, which is smaller than a certain area, from an object and extracts the regions corresponding to the same drawing conditions.

6. The ink jet printing apparatus according to claim 1, wherein the ink drying section includes a sheet transport unit that transports the sheet, and a heating unit that is disposed on a transport path of the sheet transported by the sheet transport unit.

7. The ink jet printing apparatus according to claim 6, further comprising:

a determination unit that determines whether or not a region in which temperature where the sheet reaches exceeds the prescribed range is present in a case in which the ink drying section is operated at set drying intensity; and a correction unit that corrects a transport speed of the sheet and drying intensity of the heating unit in a case in which the region in which the temperature where the sheet reaches exceeds the prescribed range is present.

8. The ink jet printing apparatus according to claim 1, wherein in a case in which a lower limit of temperature at which the deterioration of the gloss of UV varnish is capable of being prevented and blocking is capable of being prevented is denoted by T1 and an upper limit of temperature at which the deterioration of the adhesiveness of UV varnish is capable of being prevented and the deformation of the sheet is capable of being prevented is denoted by T2, the prescribed range of the temperature where the sheet reaches is set to the range of T1 to T2.

9. The ink jet printing apparatus according to claim 1, further comprising:

a reference drying intensity setting section that sets the reference drying intensity on the basis of a printing condition.

10. An ink jet printing apparatus comprising:

a printing section that prints an image on a sheet with aqueous ink by an ink jet method;

an ink drying section that dries the ink by heating the sheet having been subjected to printing;

a drying intensity setting section that sets drying intensity of the ink drying section and sets the drying intensity to intensity in which temperature where the sheet reaches is in a prescribed range; and a varnish coating section that coats the sheet of which the ink has been dried with UV varnish, wherein the drying intensity setting section includes a region extracting unit that analyzes an image to be printed on the sheet and extracts regions corresponding to the same drawing conditions prescribed by colors and the amount of ink, a drawing condition-occupied area calculating unit that calculates occupied areas corresponding to the respective drawing conditions, an individual drying intensity calculating unit that calculates drying intensity for each drawing condition by correcting reference drying intensity with a correction condition prescribed for each drawing condition, a drying intensity-occupied area calculating unit that groups drawing conditions corresponding to the same drying intensities and calculates occupied areas for the respective drying intensities, and a maximum occupied area-drying intensity selecting unit that selects drying intensity corresponding to the maximum occupied area, and the drying intensity selected by the maximum occupied area-drying intensity selecting unit is set as the drying intensity of the ink drying section.

11. A drying intensity setting method of setting drying intensity of an ink drying section in an ink jet printing apparatus including a printing section that prints an image on a sheet with aqueous ink by an ink jet method, an ink drying section that dries the ink by heating the sheet having been subjected to printing, and a varnish coating section that coats the sheet of which the ink has been dried with UV varnish, the method comprising:

a step of analyzing an image to be printed on the sheet and extracting regions corresponding to the same drawing conditions prescribed by colors and the amount of ink;

a step of calculating occupied areas corresponding to the respective drawing conditions;

a step of selecting a drawing condition corresponding to the maximum occupied area;

a step of obtaining a correction condition corresponding to the drawing condition corresponding to the maximum occupied area with reference to correction conditions prescribed for the respective drawing conditions and calculating drying intensity by correcting reference drying intensity with the obtained correction condition; and a step of setting the calculated drying intensity as the drying intensity of the ink drying section, wherein the calculated drying intensity is set as the drying intensity of the ink drying section.

12. The drying intensity setting method of an ink jet printing apparatus according to claim 11, further comprising:

a step of calculating drying intensity for each drawing condition by correcting the reference drying intensity with the correction condition prescribed for each drawing condition;

a step of grouping drawing conditions corresponding to the same drying intensities and calculating occupied areas for the respective drying intensities; and a step of selecting drying intensity corresponding to the maximum occupied area, wherein drying intensity to be set in the ink drying section is corrected to the drying intensity corresponding to the maximum occupied area in a case in which the calculated drying intensity is different from the drying intensity corresponding to the maximum occupied area.

13. A drying intensity setting method of setting drying intensity of an ink drying section in an ink jet printing apparatus including a printing section that prints an image on a sheet with aqueous ink by an ink jet method, an ink drying section that dries the ink by heating the sheet having been subjected to printing, and a varnish coating section that coats the sheet of which the ink has been dried with UV varnish, the method comprising:

a step of analyzing an image to be printed on the sheet and extracting regions corresponding to the same drawing conditions prescribed by colors and the amount of ink;

a step of calculating an occupied area corresponding to each drawing condition;

a step of calculating drying intensity for each drawing condition by correcting reference drying intensity with a correction condition prescribed for each drawing condition;

a step of grouping drawing conditions corresponding to the same drying intensities and calculating occupied areas for the respective drying intensities; and a step of selecting drying intensity corresponding to the maximum occupied area, wherein the selected drying intensity is set as the drying intensity of the ink drying section.

* * * * *